US007486300B2

(12) United States Patent
Rose

(10) Patent No.: US 7,486,300 B2
(45) Date of Patent: Feb. 3, 2009

(54) COLOR PALETTE PROVIDING CROSS-PLATFORM CONSISTENCY

(75) Inventor: Brian Rose, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 10/785,604

(22) Filed: Feb. 23, 2004

(65) Prior Publication Data

US 2004/0164991 A1 Aug. 26, 2004

Related U.S. Application Data

(63) Continuation of application No. 09/805,920, filed on Mar. 15, 2001, now Pat. No. 6,697,079.

(51) Int. Cl.
*G09G 5/02* (2006.01)

(52) U.S. Cl. ..... 345/593; 345/594; 345/595; 345/601; 715/763; 715/810; 715/835; 434/98

(58) Field of Classification Search ..... 345/593, 345/594, 601, 595; 382/168; 434/98; 715/763, 715/810, 835

See application file for complete search history.

(56) References Cited

U.S. PATENT DOCUMENTS 5,249,263 A 9/1993 Yanker
5,254,978 A 10/1993 Beretta
5,872,555 A * 2/1999 Kolar et al. ..... 345/594
5,903,255 A * 5/1999 Busch et al. ..... 345/594

OTHER PUBLICATIONS

Adobe Photoshop 6.0 User Guide, 2000, Adobe Systems Inc. pp. 330-335.
Microsoft Word 2000 (Microsoft Office 2000 Suite). 1999. Microsoft Corporation. Screenshots (1)-(3).
D. Lehn et al., "Death of the Websafe Color Palette?", XP002222963 Retrieved from the Internet: <URL:http://hotwired.lycos.com/webmonkey/00/37/index2a.html>, Sep. 6, 2003, 3 pages.
"Which Color Palette?", WEBREFERENCE.COM, Retrieved from the Internet: <URL:http://webreference.com/dev/graphics/palette.html> Jun. 10, 1996, 2 pages.
J. Gille et al., "Error Diffusion Using the "Web-Safe colors":how good is it Across Platforms?", Proc. SPIE Int.Soc.Opt. Eng. Image Vision & Elec. Imaging, Jan. 26-29, 1998, vol. 3299, pp. 368-375.

* cited by examiner

*Primary Examiner*—Antonio A. Caschera
(74) *Attorney, Agent, or Firm*—Buchanan Ingersoll & Rooney PC

(57) ABSTRACT

A method and system to provide a color palette which facilitates user selection of web-safe colors. In laying out the color palette, the extent of achromatic colors located within the color palette is determined. The achromatic colors are then arranged in one group on the palette, for instance in order of lightest to darkest. The non web-safe chromatic colors are then grouped together. From this grouping blends of the colors are created. Finally, the web-safe chromatic colors are grouped together. Blends with respect to the web-safe chromatic colors are created and then grouped on the color palette.

43 Claims, 26 Drawing Sheets

Non-web-safe colors: Macintosh

Non-web-safe colors: Windows

Web-safe colors: Macintosh

Web-safe colors: Windows

325
| | A |
|---|---|
| 1 | 000/000/100 |
| 2 | 000/000/093 |
| 3 | 000/000/087 |
| 4 | 000/000/080 |
| 5 | 000/000/073 |
| 6 | 000/000/067 |
| 7 | 000/000/060 |
| 8 | 000/000/053 |
| 9 | |
| 10 | |
| 11 | |
| 12 | |
| 13 | 000/000/020 |
| 14 | 000/000/013 |
| 15 | 000/000/007 |
| 16 | 000/000/000 |
*Fig. 10a*
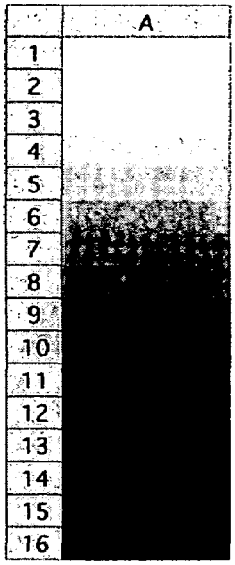
*Fig. 10b*
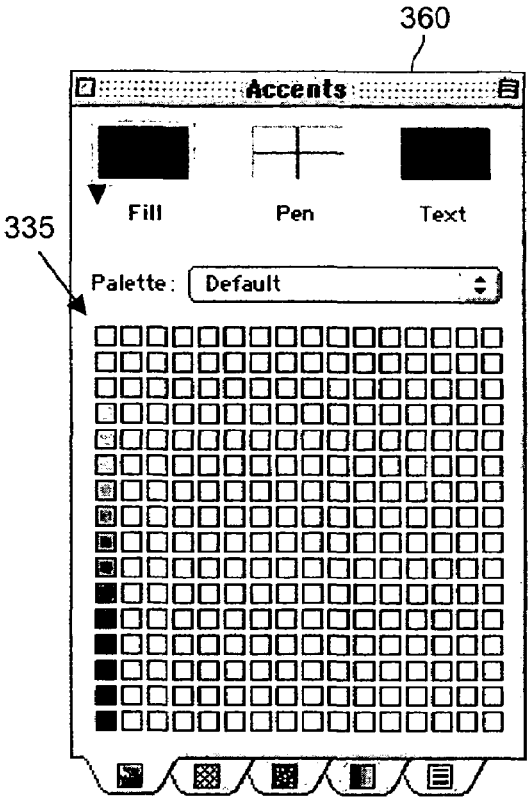
*Fig. 10c*

| | A |
|---|---|
| 1 | 000/100/093 |
| 2 | 000/100/087 |
| 3 | 000/100/073 |
| 4 | 000/100/067 |
| 5 | 000/100/053 |
| 6 | 000/100/047 |
| 7 | 000/100/033 |
| 8 | 000/100/027 |
| 9 | 000/100/013 |
| 10 | 000/100/007 |

Fig. 11a

| | A |
|---|---|
| 1 | |
| 2 | |
| 3 | |
| 4 | |
| 5 | |
| 6 | |
| 7 | |
| 8 | |
| 9 | |
| 10 | |

Fig. 11b

| | A |
|---|---|
| 1 | 120/100/093 |
| 2 | 120/100/087 |
| 3 | 120/100/073 |
| 4 | 120/100/067 |
| 5 | 120/100/053 |
| 6 | 120/100/047 |
| 7 | 120/100/033 |
| 8 | 120/100/027 |
| 9 | 120/100/013 |
| 10 | 120/100/007 |

Fig. 11c

| | A |
|---|---|
| 1 | |
| 2 | |
| 3 | |
| 4 | |
| 5 | |
| 6 | |
| 7 | |
| 8 | |
| 9 | |
| 10 | |

Fig. 11d

60° (yellow):

| | A |
|---|---|
| 1 | 060/100/100 |
| 2 | 060/080/100 |
| 3 | 060/060/100 |
| 4 | 060/040/100 |
| 5 | 060/020/100 |
| 6 | 060/100/080 |
| 7 | 060/075/080 |
| 8 | 060/050/080 |
| 9 | 060/025/080 |
| 10 | |
| 11 | |
| 12 | |
| 13 | |
| 14 | |
| 15 | |

| | A |
|---|---|
| 1 | |
| 2 | |
| 3 | |
| 4 | |
| 5 | |
| 6 | |
| 7 | |
| 8 | |
| 9 | |
| 10 | |
| 11 | |
| 12 | |
| 13 | |
| 14 | |
| 15 | |

120° (green):

180° (cyan):

240° (blue):

300° (magenta):

| | A |
|---|---|
| 1 | |
| 2 | |
| 3 | [illegible] |
| 4 | 300/040/100 |
| 5 | 300/020/100 |
| 6 | |
| 7 | |
| 8 | [illegible] |
| 9 | 300/025/080 |
| 10 | |
| 11 | |
| 12 | |
| 13 | |
| 14 | |
| 15 | |

| | A |
|---|---|
| 1 | |
| 2 | |
| 3 | |
| 4 | |
| 5 | |
| 6 | |
| 7 | |
| 8 | |
| 9 | |
| 10 | |
| 11 | |
| 12 | |
| 13 | |
| 14 | |
| 15 | |

1°-59° red-orange

| | A |
|---|---|
| 1 | |
| 2 | 015/040/100 |
| 3 | 020/060/100 |
| 4 | 030/040/100 |
| 5 | |
| 6 | 020/075/080 |
| 7 | 030/050/080 |
| 8 | |
| 9 | |
| 10 | |

orange

| | A |
|---|---|
| 1 | |
| 2 | 030/080/100 |
| 3 | 040/060/100 |
| 4 | |
| 5 | 040/075/080 |
| 6 | |

orange-yellow

| | A |
|---|---|
| 1 | 036/100/100 |
| 2 | 045/080/100 |
| 3 | 045/100/080 |

| | A |
|---|---|
| 1 | 048/100/100 |

| | A |
|---|---|
| 1 | |
| 2 | |
| 3 | |
| 4 | |
| 5 | |
| 6 | |
| 7 | |
| 8 | |
| 9 | |
| 10 | |

| | A | B | C | D | E |
|---|---|---|---|---|---|
| 1 | | | | | |
| 2 | | | | | |

*Fig. 18a*

| | A |
|---|---|
| 1 | 072/100/100 |
| 2 | 075/080/100 |
| 3 | 080/060/100 |
| 4 | 090/040/100 |
| 5 | 075/100/080 |
| 6 | 080/075/080 |
| 7 | 090/050/080 |
| 8 | |
| 9 | |
| 10 | |

| | A |
|---|---|
| 1 | 084/100/100 |
| 2 | 090/080/100 |
| 3 | 100/060/100 |
| 4 | |
| 5 | |
| 6 | |

| | A |
|---|---|
| 1 | |
| 2 | |
| 3 | |

| | A |
|---|---|
| 1 | |

| | A |
|---|---|
| 1 | |
| 2 | |
| 3 | |
| 4 | |
| 5 | |
| 6 | |
| 7 | |
| 8 | |
| 9 | |
| 10 | |

| | A | B | C | D | E |
|---|---|---|---|---|---|
| 1 | | | | | |
| 2 | | | | | |

121°-179°:

181°-239°:

241°-299°:

301°-359°:

| | A |
|---|---|
| 1 | |
| 2 | |
| 3 | 320/060/100 |
| 4 | 330/040/100 |
| 5 | |
| 6 | |
| 7 | 330/050/080 |
| 8 | |
| 9 | |
| 10 | |

| | A |
|---|---|
| 1 | |
| 2 | |
| 3 | |
| 4 | |
| 5 | |
| 6 | |

| | A |
|---|---|
| 1 | |
| 2 | |
| 3 | |

| | A |
|---|---|
| 1 | |

| | A |
|---|---|
| 1 | |
| 2 | |
| 3 | |
| 4 | |
| 5 | |
| 6 | |
| 7 | |
| 8 | |
| 9 | |
| 10 | |

| | A | B | C | D | E |
|---|---|---|---|---|---|
| 1 | | | | | |
| 2 | | | | | |

COLOR PALETTE PROVIDING CROSS-PLATFORM CONSISTENCY

This application is a continuation of application Ser. No. 09/805,920 filed on Mar. 15, 2001 now U.S. Pat. No. 6,697,079.

FIELD OF THE INVENTION

The present invention is related to color graphics for computers, and more particularly to the design and layout of a color palette that facilitates user selection of colors that have a consistent appearance across different platforms.

BACKGROUND OF THE INVENTION

As technology has improved over the years, the once novel use of color in images and text has become prevalent in everyday situations. The use of color in documents, emails, web pages, etc. has enhanced the visual stimulation of information transferred between individuals and groups. Color use has grown partly due to the fact that many multimedia and image manipulation programs have provided users with the capability to employ colors, for example, in the design and creation of images. In creating these color images and/or text, a color palette is typically provided that enables users to select the colors they would like to employ. Typically, a color palette is comprised of primary colors and several shades formed by blends of the primary colors.

In recent years as the Internet has grown, the use of colors for images and text on the Internet has also expanded. The software programs that enable users to create web pages have become increasingly user friendly and therefore do not require a vast understanding of web-page development programming. As a result, these programs are widely used by consumers as well as professional designers. Many of these programs have a color palette with its own set of colors from which users may select. However, not all colors contained in a program's color palette may be considered to be "safe" for use in web pages. More particularly, some colors will not look the same as originally intended when viewing them on different computers or with different application programs. For example, the Macintosh® operating system distributed by Apple Computer, Inc. and the Windows® operating system distributed by Microsoft Corp. may cause the same document retrieved over the Internet to appear differently, because of the respective manners in which these two systems display certain colors. Colors which do not provide a consistent appearance across different platforms are considered to be "non web-safe".

Many programs have a color palette in which web-safe colors and non web-safe colors are separated, to make it easier for users to distinguish between the two. However, for non-professionals, specific colors may be difficult to find, and achromatic colors, such as black, white and shades of gray, may also be difficult to find.

Thus, it is an object of the present invention to provide a color palette which facilitates the selection of web-safe colors, while also making it easy for users to select specific colors and/or achromatic colors.

SUMMARY OF THE INVENTION

The present invention provides methods and systems for providing a color palette which facilitates user selection of web-safe colors. In laying out the color palette, the extent of achromatic colors located within the color palette is determined. The achromatic colors are arranged as a separate group, for example in order of lightest to darkest. The non web-safe chromatic colors are also grouped together. From this grouping blends of the colors are created. Similarly, the web-safe chromatic colors are grouped together according to their respective hues, and within groups they are arranged by degree of saturation. Blends of the web-safe chromatic colors are created and grouped on the color palette according to this arrangement.

In an exemplary embodiment of the invention, a 16×16 grid is used to provide a 256-color palette. The achromatic colors are arranged along one row or column of the grid e.g., from lightest in the upper left corner to the darkest in the lower left corner of the palette. Further, the non web-safe chromatic colors are arranged along two adjacent rows or columns at one edge of the grid, e.g. the top. The remaining positions are used for the web-safe chromatic colors. These colors are grouped into six areas each representing a 60° section of the HSV color wheel. The chromatic colors are separated into primary and secondary colors, where the primary colors are the pure colors while the secondary colors are those formed from blends of the pure colors.

In another embodiment of the invention the achromatic colors are arranged on the first column so that the non web-safe and web-safe colors are separated from each other.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

Various exemplary embodiments of this invention will be described in detail, with references to the following figures, wherein:

FIGS. 10*a*–10*c* are exemplary illustrations of achromatic colors and placement on a color palette;

FIGS. 11*a*–11*g* are exemplary illustrations of non web-safe chromatic colors and placement on a color palette;

FIGS. 12*a*–23*b* are exemplary illustrations of chromatic web-safe colors and placement on a color palette;

DETAILED DESCRIPTION

Figure 1:
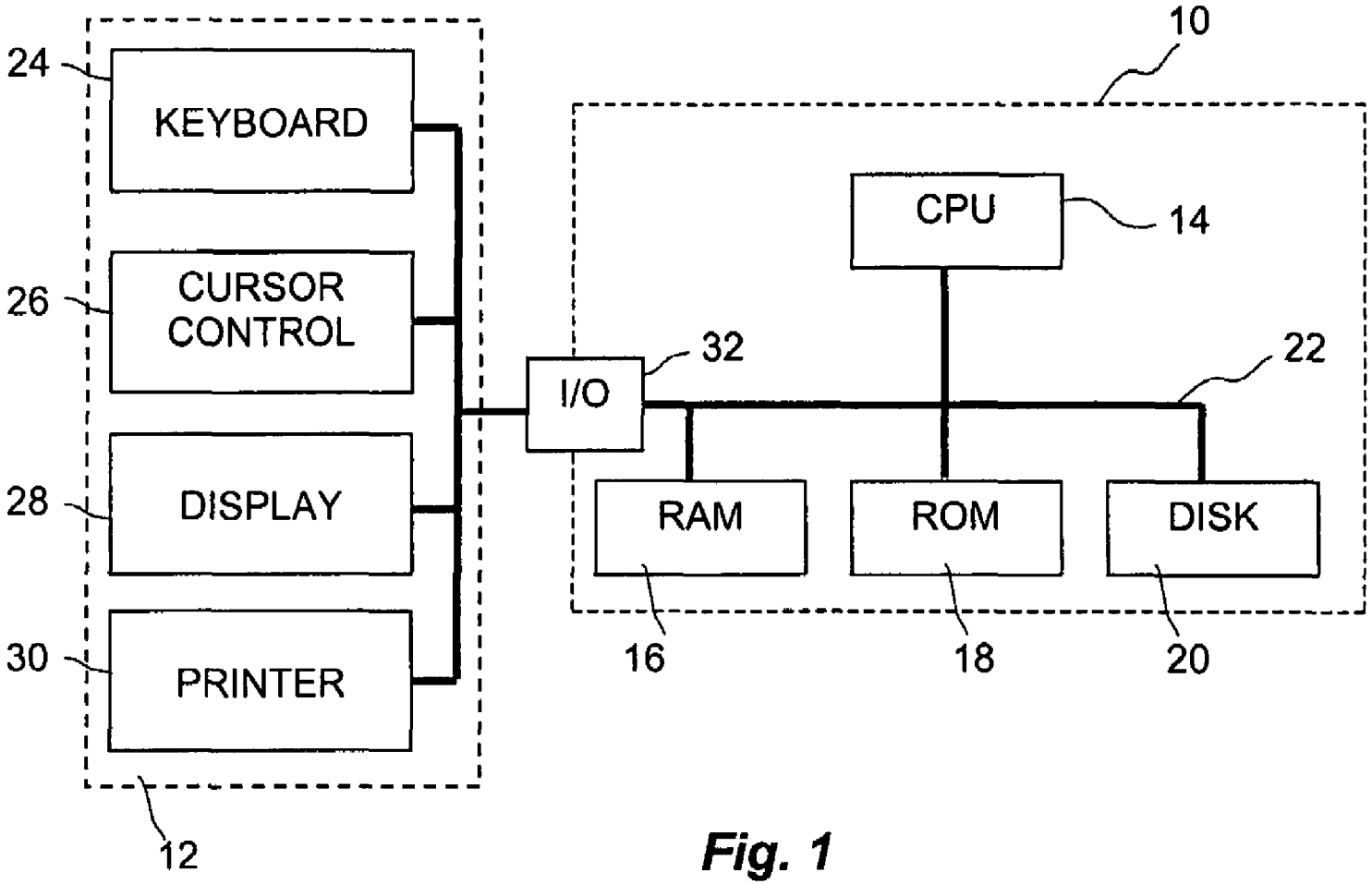
FIG. 1 illustrates a block diagram of a typical computer system in which the present invention can be implemented.

FIG. 1 illustrates a block diagram of a typical computer system in which the present invention can be implemented.

The structure of the computer itself does not form part of the present invention. It is briefly described here for subsequent understanding of the manner in which the features of the invention cooperate with the structure of the computer. It should be noted that any computer system that is capable of implementing the concepts of the present invention can be used to employ those concepts.

Referring to FIG. 1, the system includes a computer 10 having a variety of external peripheral devices 12 connected thereto. The computer 10 includes a central processing unit (CPU) 14, a main memory which is typically implemented in the form of a random access memory 16, a static memory that can comprise a read only memory 18, and a permanent storage device, such as a magnetic or optical disk 20. The CPU 14 communicates with each of these forms of memory through an internal bus 22. The peripheral devices 12 include a data entry device such as a keyboard 24, and a pointing or cursor control device 26, such as a mouse, trackball or the like. A display device 28, such as a CRT monitor or an LCD screen, provides a visual display of the information that is being processed within the computer, for example the contents of a document or an Internet web page. A hard copy of this information can be provided through a printer 30, or similar such devices. Each of these external peripheral devices communicates with the CPU 14 by means of one or more input/output ports 32 on the computer.

Various types of application programs can be loaded into the main memory 16 and executed by the CPU 14. One type of program to which the present invention is particularly directed comprises a color graphics program, via which a user can designate the colors of objects within a document, such as a web page. These objects can be text, geometric objects, images, and the like. To facilitate the user's ability to select a color for a given object, many such programs include a color palette that can be displayed on the display device. Using the pointing device 26 the keyboard 24, and/or other input device, the user can designate a particular color on the palette and then indicate the object or objects to which that color is to be applied.

The present invention is directed to a color palette that allows users to distinguish web-safe colors from non-web safe colors, while also providing a visually pleasing layout that makes it possible for users to easily select the color they want to use, including achromatic colors. Therefore, trial and error situations and guesswork are reduced. Web-safe colors are defined as those colors that are displayed in a consistent manner among common web browsers, operating systems, and computer platforms. Non web-safe colors include those colors whose appearance may vary when displayed by different web browsers, operating systems and/or computer platforms. While the terms "web-safe" and "non web-safe" connote documents that are accessed via the Internet, such as web pages, it will be appreciated that the applications of the invention are not limited to this situation. Rather, in the context of the invention, these terms are being employed in a generic sense to identify whether colors are displayed with a consistent appearance across multiple platforms and/or applications, regardless of the source of the documents in which they appear.

A specific example of the invention is described below in conjunction with an 8-bit, 256-color palette on a 16×16 grid. This particular type of palette provides a particularly illustrative example of the problem addressed by the invention since, by convention, the specific 256 colors of the palette are predefined. As a result, the designer is constrained to using those particular colors when laying out the palette. However, it should be noted that the methods described are not limited to either a square grid or a 256-color palette, and may be used on any size color palette and grid.

Figure 2:
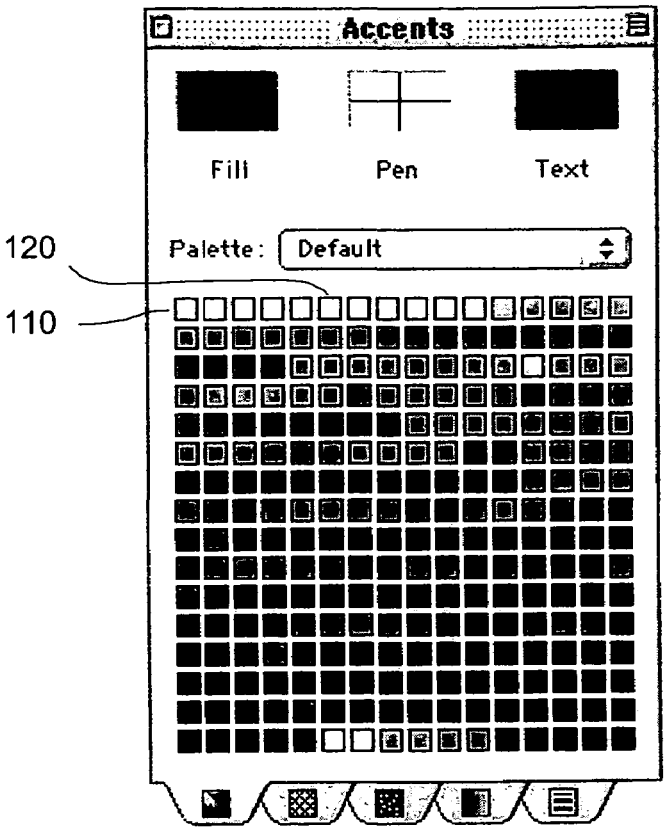
FIG. 2 is an illustration of a first example of a prior art color palette.
Figure 3:
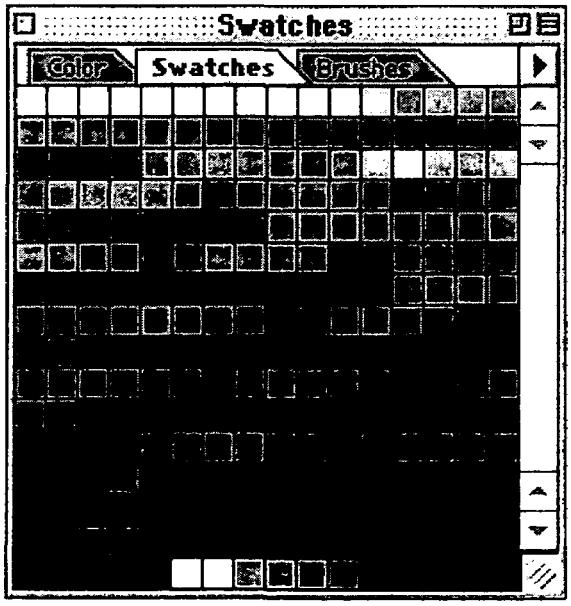
FIG. 3 is an illustration of another example of a prior art color palette.
Figure 4:
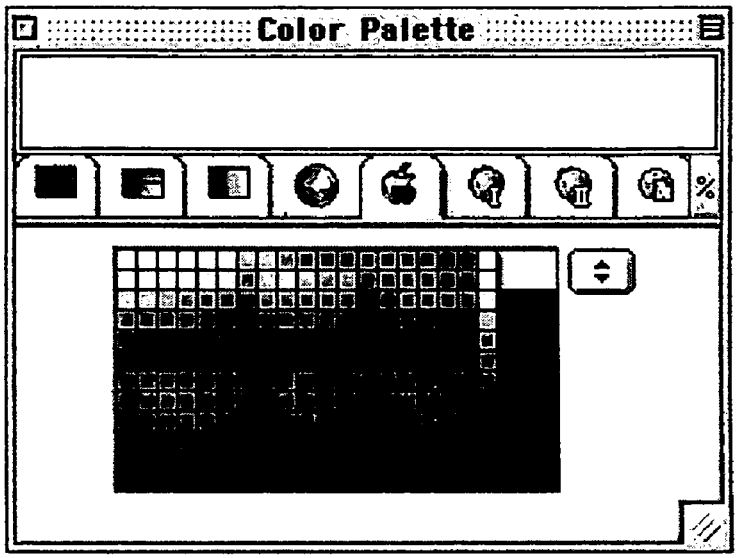
FIG. 4 is an illustration of a third example of a prior art color palette.

FIGS. 2–4 are examples of various color palettes that are utilized in different programs known in the prior art. FIG. 2 illustrates a default 256-color palette as used in a multi-application program that provides word processing, drawing and painting capabilities. Beginning with the first color 110 in the upper left corner and moving right to the sixth color 120, there is a progressive blend from white toward fully saturated yellow. Continuing in this left-to-right direction and from top to bottom in the grid, there is an array of various blends of colors. There is no specific order to the layout of the colors. The different red- blue- and green-based colors are scattered throughout the palette, together with random, predetermined blends. This layout may present difficulties for inexperienced users when trying to select a specific color.

FIG. 3 illustrates a default color palette used in another popular graphics program. This palette is arranged similar to the color palette of FIG. 2 and presents the same difficulties in selecting colors.

FIG. 4 illustrates a default color palette used in another known product. This color palette isolates the web-safe colors from the non web-safe colors. However, the resulting blends are arbitrarily predetermined, as a result of which the appearance of specific colors is conditional. More particularly, the blends are not based on a hue alone, and therefore do not present a reliable appearance to the user. Since multiple hues are mixed in a single blend, the appearance of an individual color is influenced by surrounding colors, e.g. the user may not be able to distinguish a light yellow from a light orange. As a result, guesswork is involved in the selection of a specific color. Further, achromatic colors, i.e., shades of gray, are dispersed, or "hidden", within the chromatic colors in the color palette.

Figure 5:
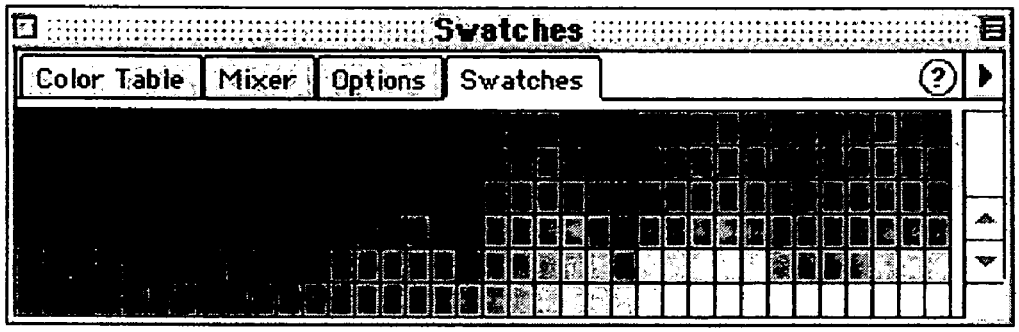
FIG. 5 is an illustration of a fourth example of a prior art color palette.
Figure 6:
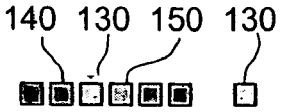
FIG. 6 is an illustration of a hidden gray located in a color palette.

FIG. 5 illustrates a default color palette used in another known program. This color palette only uses web-safe colors. The resulting blends are also predetermined and incorporate hidden grays. Hidden grays are shades of gray that appear in the color palette as a result of random or predetermined blends. FIG. 6 illustrates a sequence of blends, taken from the color palette of FIG. 2, in which the third color 130 lying between a blue 140 and a green 150 appears to be some mixture of blue 140 and green 150, but is really a gray. Thus, it is difficult for users to discern the gray from the blue and the green which may lead the user to select the wrong color.

Figure 7A:
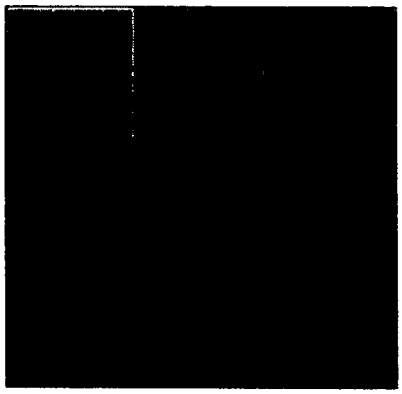
FIGS. 7*a*–7*d* are illustrations of non web-safe and web-safe colors on two different computing platforms.
Figure 7B:
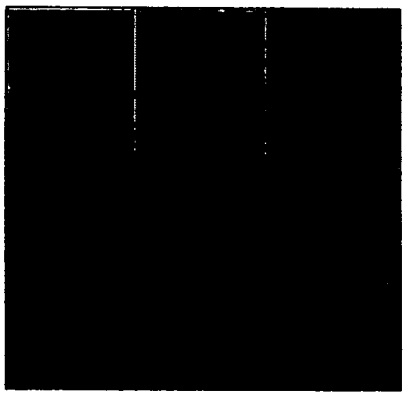
Figure 7C:
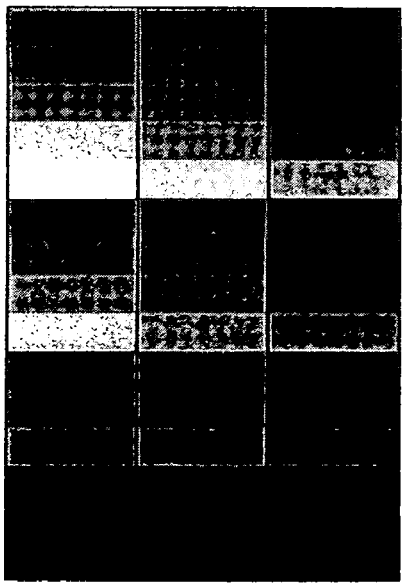
Figure 7D:
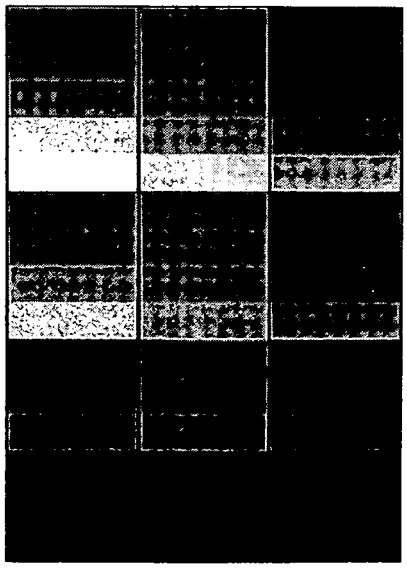

FIGS. 7*a*–7*d* illustrate the difference between web-safe colors and non web-safe colors as viewed on two different computing platforms, e.g., the Macintosh and Windows operating systems, respectively. FIGS. 7*a* and 7*c* depict certain colors as they are displayed within the Macintosh environment, whereas FIGS. 7*b* and 7*d* depict those same colors as displayed in the Windows environment. As can be seen, there are 40 non web-safe colors in FIGS. 7*a* and 7*b* that appear differently in the Macintosh environment (FIG. 7*a*) from those in the Windows environment (FIG. 7*b*). However, with the web-safe colors of FIGS. 7*c* and 7*d*, there is no perceptible variation in appearance across the Macintosh and Windows platforms.

One embodiment of the method for arranging colors in a color palette in accordance with the present invention will now be described, with reference to the flow chart of FIG. 8. As an initial step, the colors that are to appear in the palette are determined at step 200. This is accomplished by determining the hue angle, saturation and value or "lightness" (HSV) parameters for each of the colors. The HSV values are best understood with reference to a color wheel 305, illustrated in FIG. 9. The hue angle (H) 310 is measured from 0° to 360° in a counterclockwise direction around the color wheel. Saturation (S) 315 and lightness values (V) 320 are expressed in a range between 0% and 100%.

Hue represents the attribute that is normally associated with the name of a color, for example, red, purple, blue, etc. Hue is more specifically defined by the wavelength associated with colors. Hue is also a term which describes a dimension of color that is readily experienced when looking at a color. Hue can be thought of as a dimension going around the color wheel, from 0° to 360°.

Color is also perceived along two other dimensions. One of the dimensions is lightness darkness. The measurement of the lightness or darkness of a color is referred to either as a color's lightness or value 320. In terms of a spectral definition of color, value describes the overall intensity or strength of the light which produces that color, where pure white has a value of 100% and pure black is 0%. Value 320 can be envisioned as a linear axis running through the middle of the color wheel 305, normal to the plane of the figure.

Saturation 315 refers to the dominance of hue in the color. On the outer edge of the color wheel 305 are what is known as the 'pure' hues. Moving toward the center of the wheel, the hue of a given pure color, such as red, blue etc, dominates less and less. At the center of the wheel, no hue dominates. The colors directly on the central axis are considered to be desaturated, or achromatic. The desaturated colors constitute the grayscale, running from white to black with all of the intermediate grays in between. Saturation 315, therefore, is the radial dimension running from the center of the hue wheel, fully desaturated, to the outer edge, fully saturated, perpendicular to the value axis. In terms of a spectral definition of color, saturation is the concentration of color at a given hue angle. Any given color corresponds to a single wavelength and therefore to a single hue angle. White light is fully desaturated because it contains an even balance of all wavelengths.

Once the colors of the palette have been identified, they are divided into three classes, namely achromatic colors, non web-safe chromatic colors, and web-safe chromatic colors, for further processing. These three classes can be processed in any order, since the colors in each group are exclusive of one another. FIG. 8 illustrates one exemplary order for processing the colors. In step 210 a determination is made of the achromatic colors, i.e., black, whites and grays, that exist within the palette. The determination of achromatic colors in a given color palette produces a range of grays from white to black as shown in FIGS. 10*a*–10*b*. The range of achromatic colors 325 in FIG. 10*a* are shown with the corresponding HSV values which define the colors, expressed in the format hue/saturation/value. For example, the color shown in row 1 of FIG. 10*a* has a hue angle of 0°, a saturation of 0% and a value of 100%, i.e., pure white. FIG. 10*b* illustrates the same colors, without the HSV values superimposed on them.

Once they have been identified, the achromatic colors are arranged as a contiguous grouping on the color palette grid at step 220. In one embodiment of the invention the achromatic colors are arranged from lightest, white, to darkest, black. These achromatic colors are arranged along one edge of a grid in the palette, i.e. a row or column. As shown in FIG. 10*c*, they are arranged in order of decreasing value down the left-most column 335 on the grid of a palette 360. The 16 achromatic colors do not have to be arranged exactly as shown in FIG. 10*c*. They can be placed any given row or column of the grid, and/or arranged on plural contiguous rows or columns.

Figure 8:
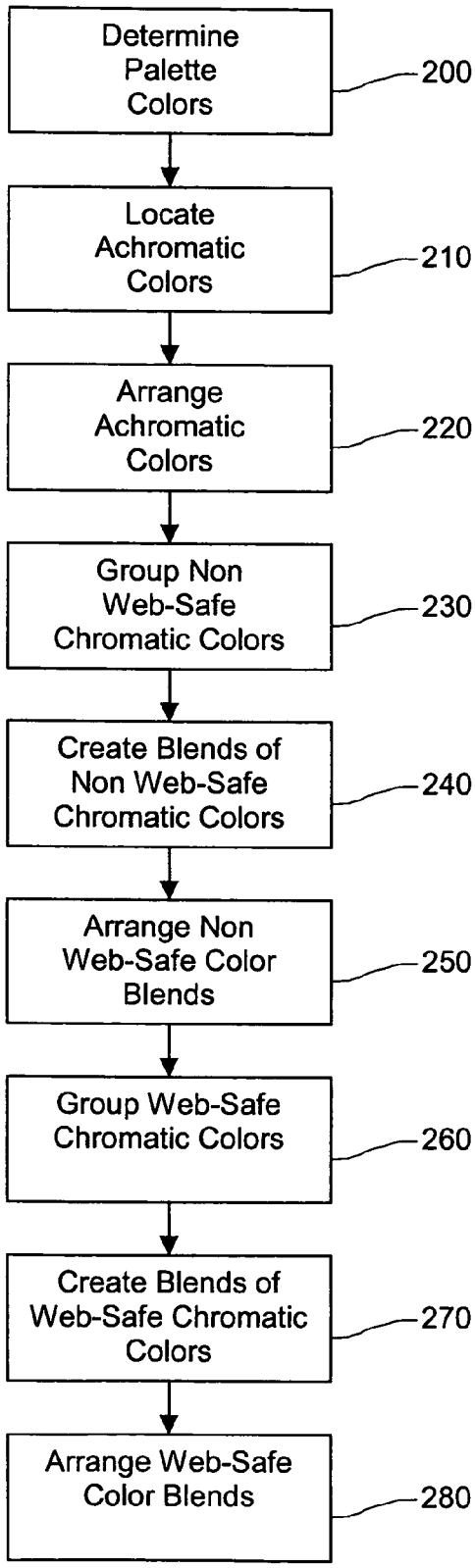
FIG. 8 is a flow chart of a method for designing a color palette in accordance with the present invention.
Figure 9:
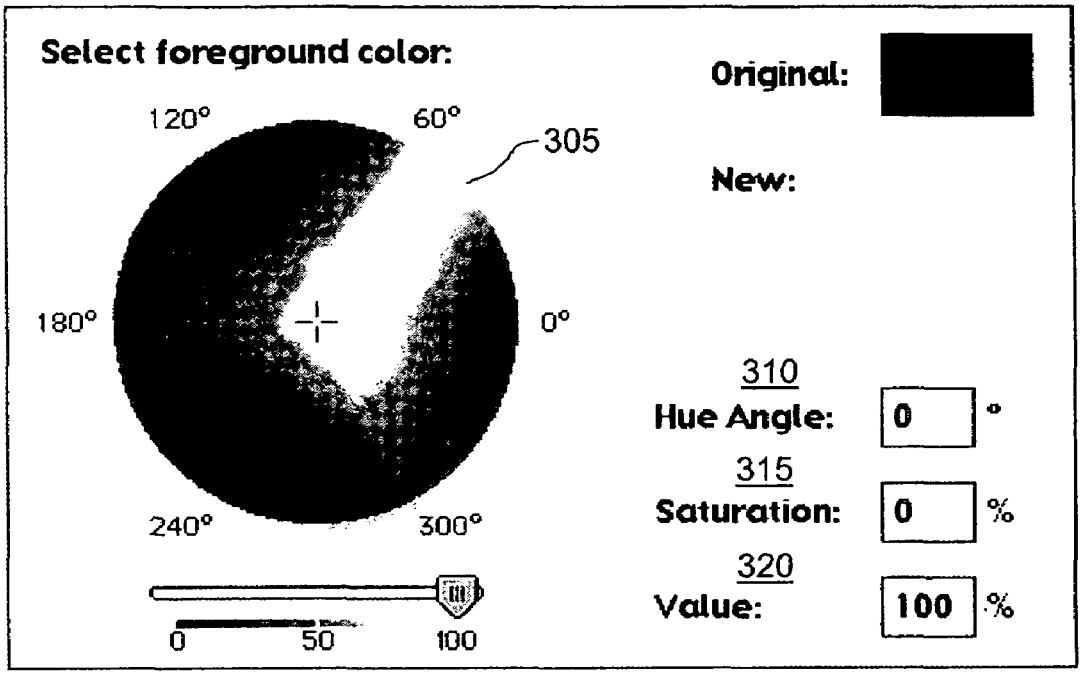
FIG. 9 is an illustration of a color wheel.
Figure 11E:
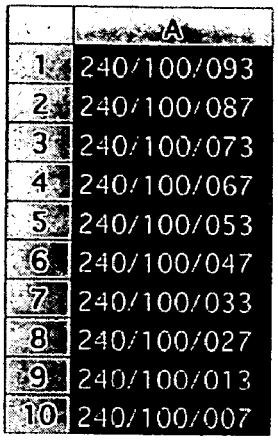
Figure 11F:
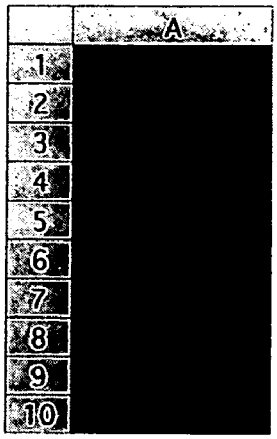
Figure 11G:
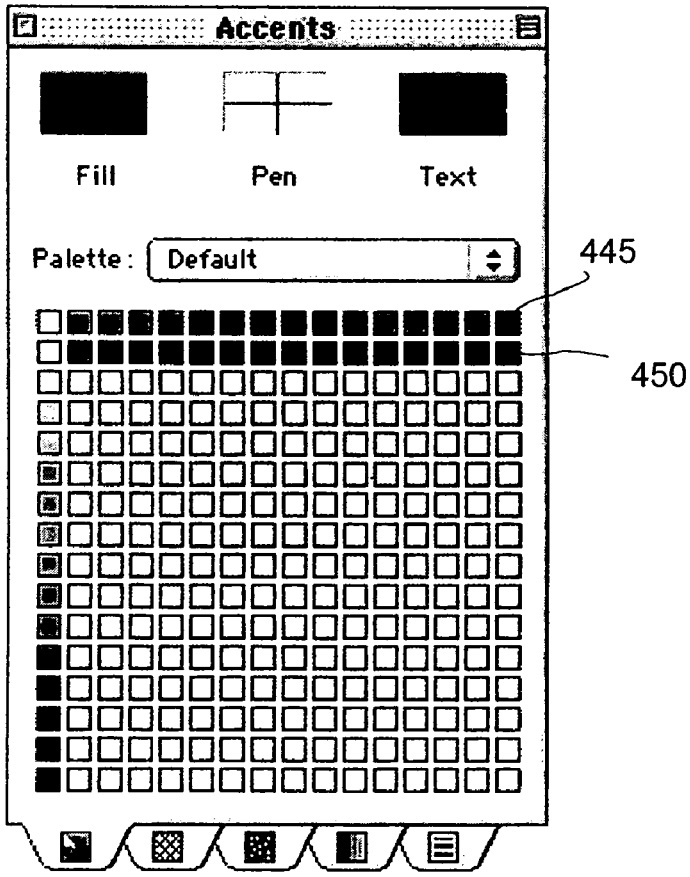

In the embodiment of FIG. 8, after the achromatic colors have been determined and arranged on the color palette 360, the non web-safe chromatic colors are grouped in step 230. The pure colors of red, blue and green are used in this example. From the color wheel 305, the pure red color has a hue angle value H of 0°, the pure green H value is 120° and the pure blue H value is 240°. In order to classify these colors as pure, they must also have an S value of 100%. By definition, the classification of these colors as non web-safe colors precludes them from having a V value of 100, 80, 60, 40 or 20 in a 256-color, or 8-bit, palette. Therefore, blends using the non web-safe chromatic colors are created at step 240. FIGS. 11*a*–11*f* illustrate ten blends from each of the pure red, blue and green colors that appear in the 256-color palette. The S values of these blends are all 100%, while the V values change in a linear progression within the range from 0% to 100%. These colors are arranged as a contiguous group on the color palette at step 250. Referring to FIG. 11*g*, the non web-safe chromatic colors are arranged from lightest to darkest on the first two rows 445 and 450, starting with the reds on row 445 and ending with the blues on row 450. The 30 colors fit evenly on the two rows without overlap.

The web-safe chromatic colors are grouped in a contiguous, logical manner at step 260. The web-safe colors are principally grouped by hue, and within each hue grouping by saturation and value, similar to the non web-safe colors and achromatic colors. The HSV color wheel 305 has 6 primary hues, each at 60° intervals. The six hue angles comprise red at 0°, yellow at 60°, green at 120°, cyan at 180°, blue at 240° and magenta at 300°. Within each of these principal groups, the web-safe colors are arranged into sub-groups that correspond to V values of 100, 80, 60, 40 and 20. Once these sub-groups are defined, blends are created from each of the sub-groups at steps 270, thereby providing a full spectrum of primary web-safe chromatic colors. Once they have been chosen, these blends are arranged on the color palette at step 280.

Figures 12A, 12B:
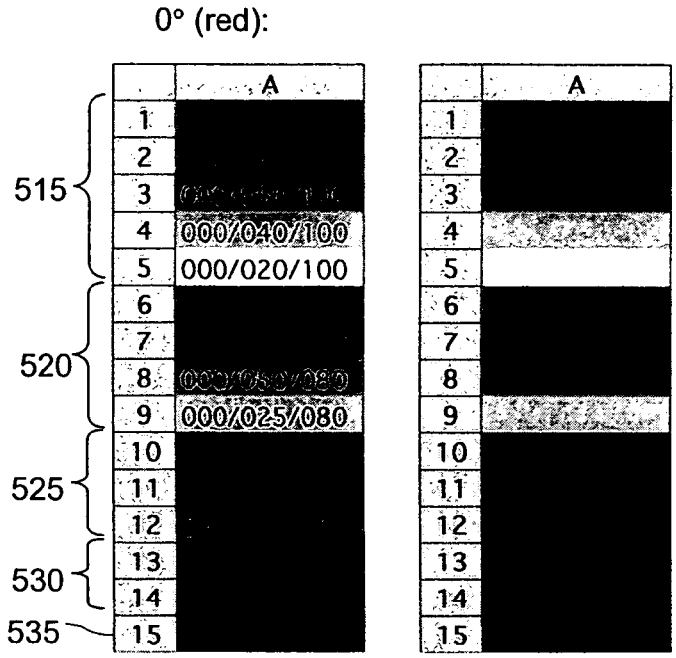
Figure 12C:
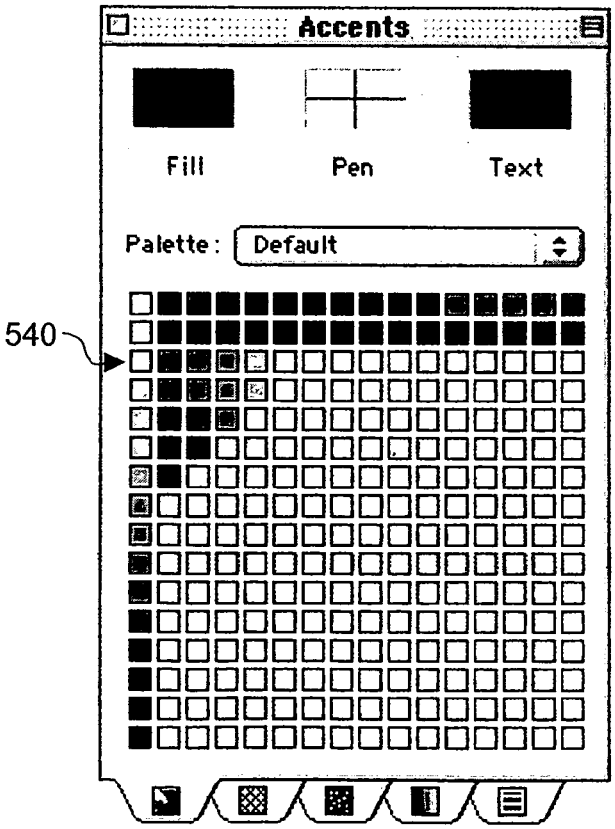

FIGS. 12*a*–12*b* illustrate the blends created from the color red by changing the S values and V values. The blends created in the first sub-group 515 have a V value of 100%. The S value changes in increments of 20% to provide the first sub-group of five blends. The V value in the second sub-group 520 is 80%. The S values in this sub-group start at 100% and change in increments of 25% to provide four blends. The third sub-group 525 has a V value of 60 and the S values change in increments of 33%. The fourth sub-group 530 has a V value of 40 and the S values change in increments of 50%. Finally, the fifth sub-group 535 has a V value of 20 and an S value of 100. There is no change in the V value for the fifth sub-group 535 as it contains only one color. The pattern described above is the same pattern used in each of the primary web-safe colors that are described hereinafter.

Once the blends are created they are arranged on the color palette 360. The blends are arranged by placing each sub-group in a corresponding row of the palette grid. The first sub-group 515 is arranged on the first available row 540 of the color palette 360, in decreasing order of saturation from left to right. The second sub-group 520 is arranged in decreasing order of saturation on the row directly below the first sub-group 515. The third sub-group 525 is arranged directly below the second sub-group 525, again in order of decreasing saturation value 550. The fourth sub-group 530 is arranged below the third sub-group 525 in order of decreasing saturation. Finally, the fifth sub-group 535 containing only one color is arranged below the fourth sub-group 530.

Figures 13A, 13B, 13C:
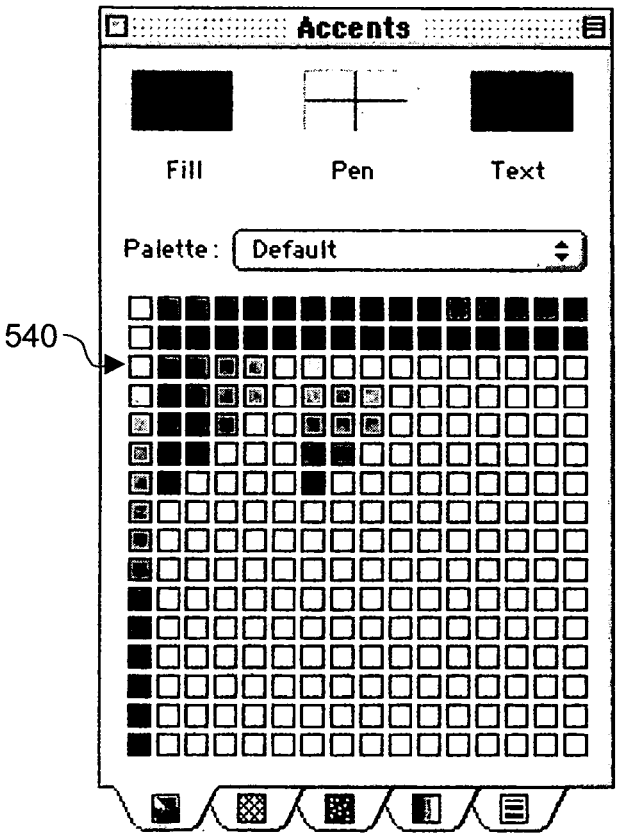

FIGS. 13*a*–13*c* depict the same procedure for an H value of 60° which pertains to the color yellow. The yellow web-safe colors are broken into sub-groups and blended in the same manner as the red web-safe colors described above. The yellow web-safe colors are arranged on the color palette 360 in the same manner as the reds. However, the yellow colors are shifted to the right 5 color positions on the grid. The first subgroup of yellow blends is located adjacent the last red color in row 540. The remaining yellow subgroups are arranged on the grid in a left block format, with each pure yellow color of each sub-group placed on the grid directly below the first starting color of the previous sub-group.

Figure 14A:
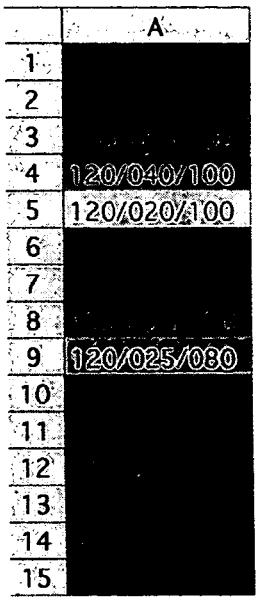
Figure 14B:
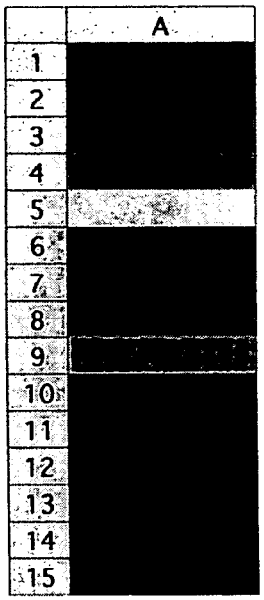
Figure 14C:
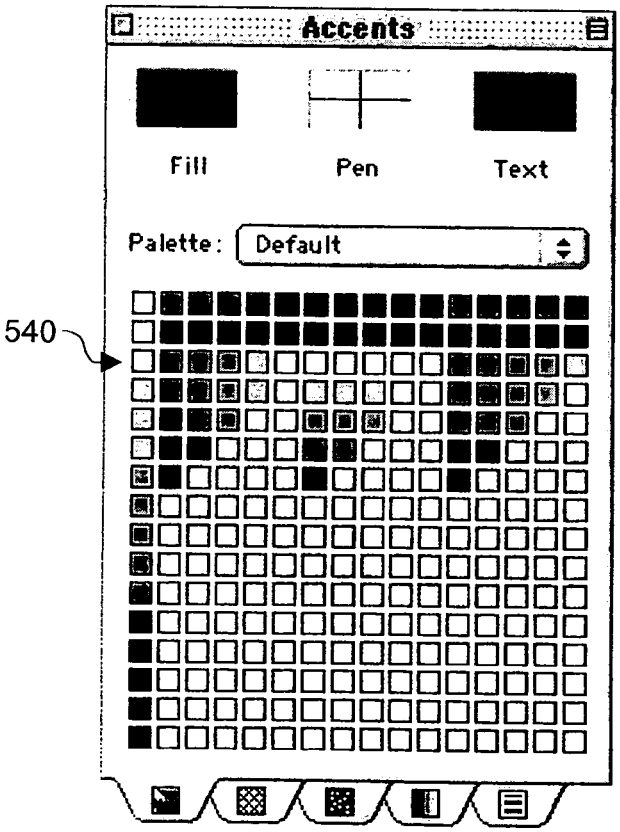

FIGS. 14*a*–14*c* depict this procedure in connection with the color green, which has an H value of 120°. The blends of green are selected in the same manner as the yellows and reds according to the technique described above. The greens are arranged next to the yellows on the color palette 360. The first row of green blends, corresponding to the first sub-group, is arranged next to the last yellow on the first row 540. The four remaining rows of green are arranged starting with the first green color in each row located directly below the first green color of the previous row. As can be seen in FIG. 14*c*, the first three colors fit perfectly across the grid of the color palette 360.

Figure 15A:
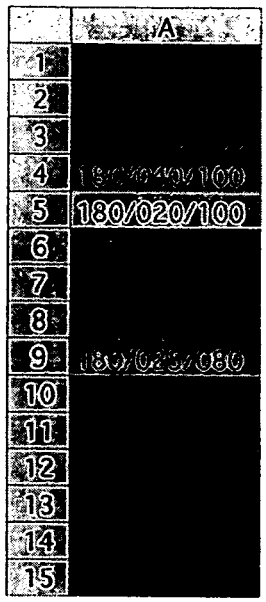
Figure 15B:
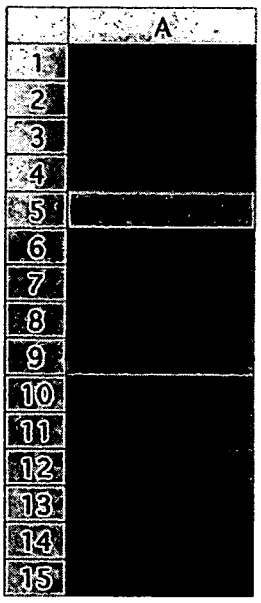
Figure 15C:
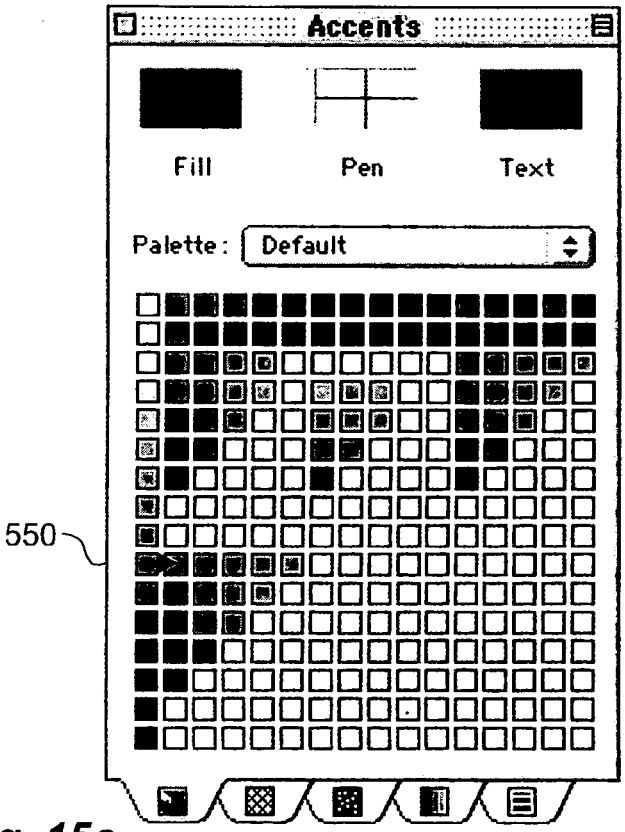

FIGS. 15*a*–15*c* illustrate the cyan colors with an H value 180°. The blends of cyan are created in the same manner as detailed above. The cyan blends are then arranged on the color palette starting in the tenth row of the second column on the 16×16 grid. The first row of the cyan begins two rows below the last row of the previous colors. Therefore the first sub-group is arranged on the grid starting at the tenth row, second column. The subsequent sub-groups are arranged starting with the second sub-group located directly below the first sub-group, and the third sub-group directly below the second sub-group and so on until the fifth sub-group is arranged on the grid.

Figure 16A:
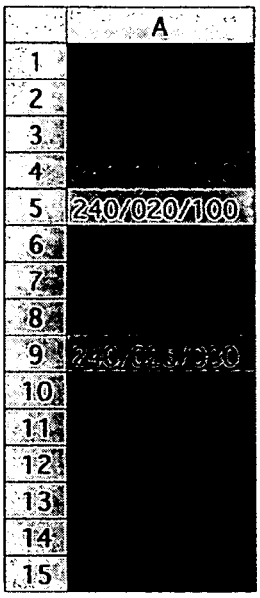
Figure 16B:
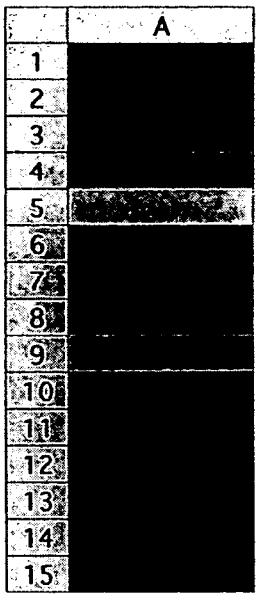
Figure 16C:
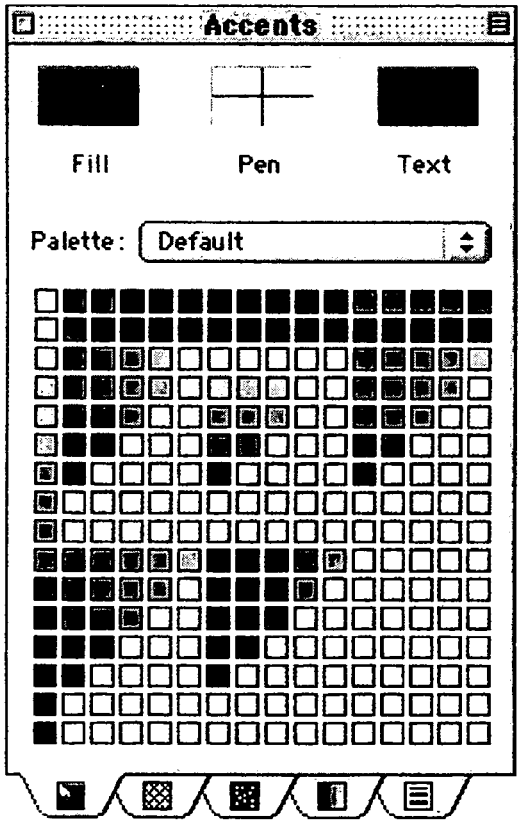

FIGS. 16*a*–16*c* correspond to the color blue, having an H value of 240°. The blends are arranged on the grid below the yellow and next to the cyan. The first color in the first sub-group is located at the tenth row 550, seventh column. The first sub-group extends across the tenth row by decreasing S value. The remaining sub-groups are arranged directly below each other, the same as the previous web-safe colors.

Figures 17A, 17B, 17C:
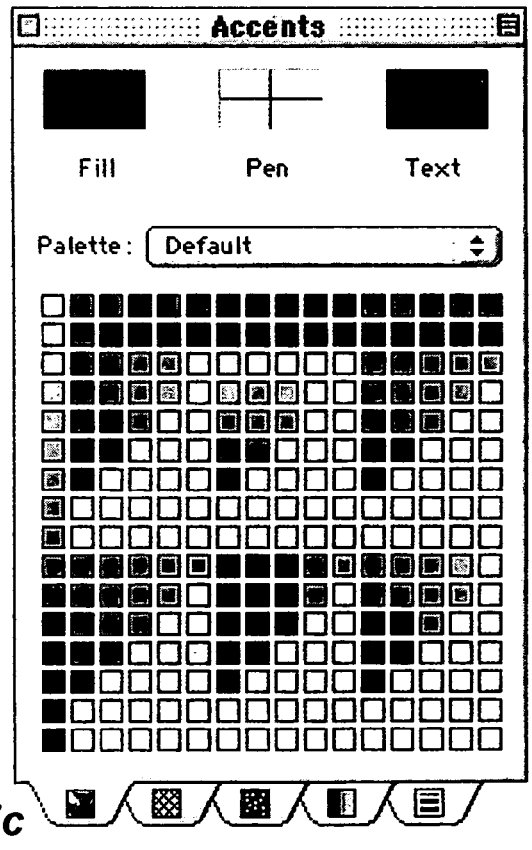

FIGS. 17*a*–17*c* represent the last primary color, which is magenta with an H value 300°. The magenta blends are arranged on the color palette 360 beginning on the tenth row 550, twelfth column. The first sub-group is arranged across the tenth row beginning immediately after the first sub-group of the blue color. The following sub-groups are arranged according to the methods described above.

Once all primary colors have been arranged on the color palette 360 grid in this manner, the next step in grouping the web-safe chromatic colors is to sort the remaining colors by hue angle. For example, all colors that are between 0° and 60° can be placed between red and yellow on the color palette grid. On the color wheel 305 there are various colors that range from red-orange, to orange, to orange-yellow that are located on the color wheel 305 between 0° and 60°, which correspond to colors in the range from 1° to 59°. These colors are formed by a combination of the primary colors red and yellow and are called secondary colors.

Figure 18B:
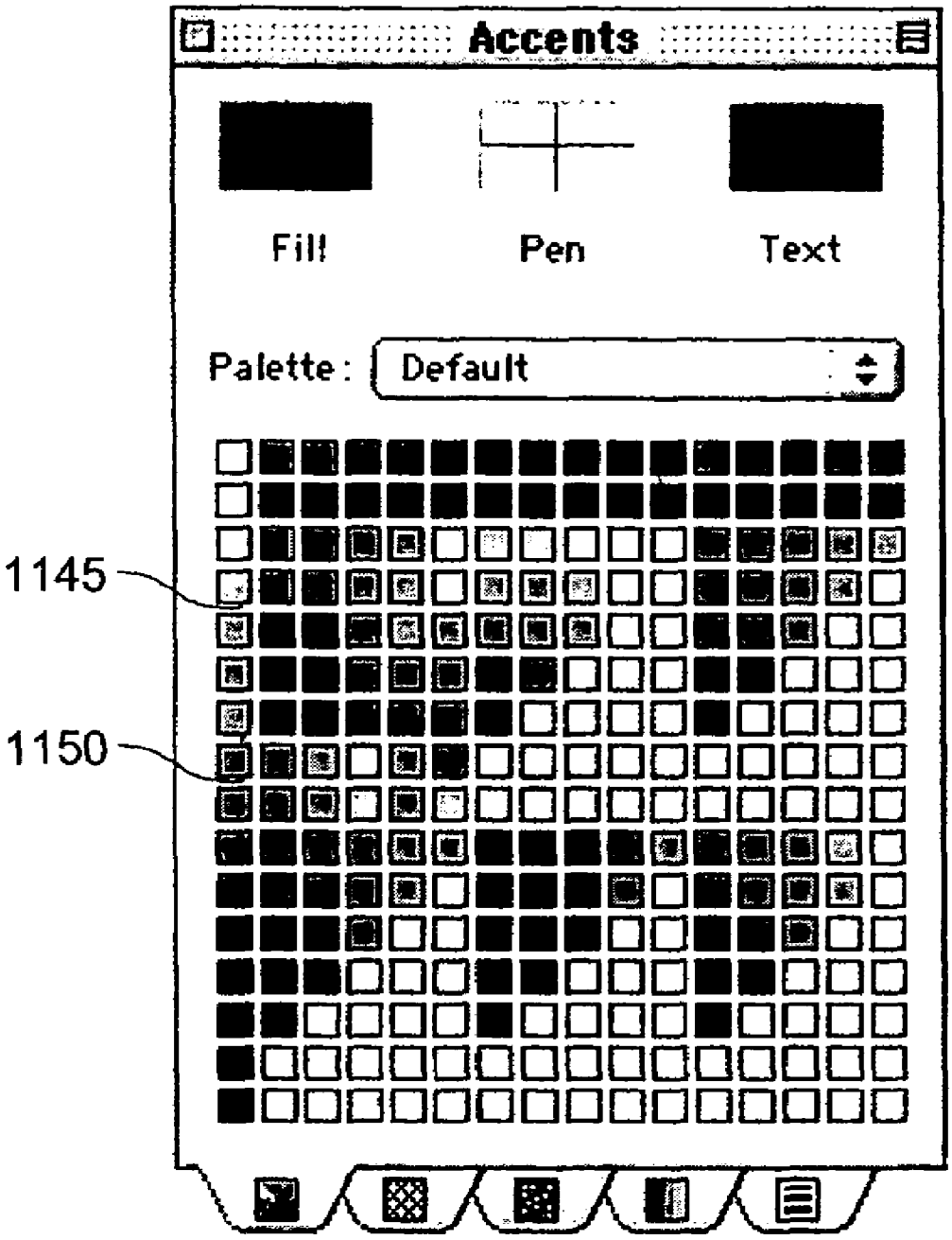

The secondary colors are arranged in a logical progression that is apparent to the viewer and coincides with the order in which the colors appear on the HSV wheel 305. FIG. 18*a* shows the colors between 1° and 59°. In sorting these colors there are produced 10 colors for red-orange, 6 colors for orange and 4 colors for orange-yellow. FIG. 18*b* illustrates the colors as they appear on the color palette 360.

The first color (012/100/100) in the red-orange colors is the reddest and has the smallest hue angle. Therefore, it is closest to 0°, which is red. This color is placed in the lower right corner of the square 1145 defined by the red blends. This square comprises two halves that are divided by a diagonal running from the lower left corner to the upper right corner. The upper half of the square contains the primary colors and the lower half contains the secondary colors. In arranging the primary colors in this square, the upper right corner of the diagonal is the least saturated and the lowest left corner is the lowest in value. The secondary colors in the lower half of the square are symmetrically arranged in a similar manner. The first blend comprising 4 colors at a 100% value flows from the bottom right of the square 1145 in an upward direction, decreasing in saturation. The second blend, 3 colors at 80% value, are placed left of the first blend, starting from the bottom of the square and going up in order of decreasing saturation. The third blend is placed directly left of the second blend. The third blend contains 2 colors of 60% value, the first color being placed at the bottom of the square and the second color immediately above it. The final blend is placed directly left of the third blend. It contains 1 color at 40% value. The square is now complete for all colors in the red/red-orange range.

However, there are 10 remaining colors from the orange and orange-yellow range. These colors are arranged in the 10 positions that form a rectangle 1150 directly below the square. The color having the most orange (024/100/100) is placed in the upper left position of the rectangle. The color having the most orange-yellow (048/100/100) is placed in the lower right position. The rest of the colors are placed in position by increasing the hue angle left to right, such that the colors with the lower saturation and/or value are located on the top row of the rectangle. The rectangle is now completed.

The remaining squares on the color palette 360 are completed in the same manner as described above. The colors which are represented at the different hue angles on the color wheel 305, are placed in corresponding positions on the color palette 360. FIGS. 19*a*–23*b* illustrate the remaining colors and the placement of those colors on the color palette 360.

Figures 19A, 19B:
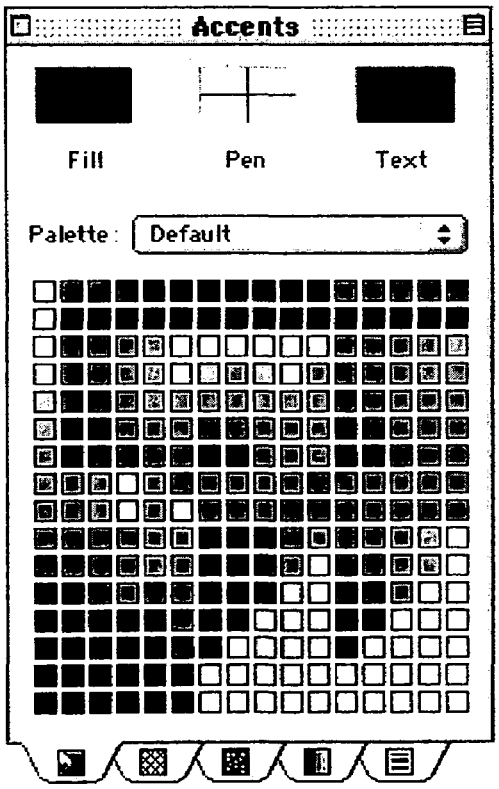

FIGS. 19*a* and 19*b* illustrate the colors in the range of 61° to 119° on the color wheel 305. These colors contain yellow and green components. The colors are placed within the square in the same manner as previously described, the only difference being the starting and ending positions on the color palette 360.

Figure 20A:
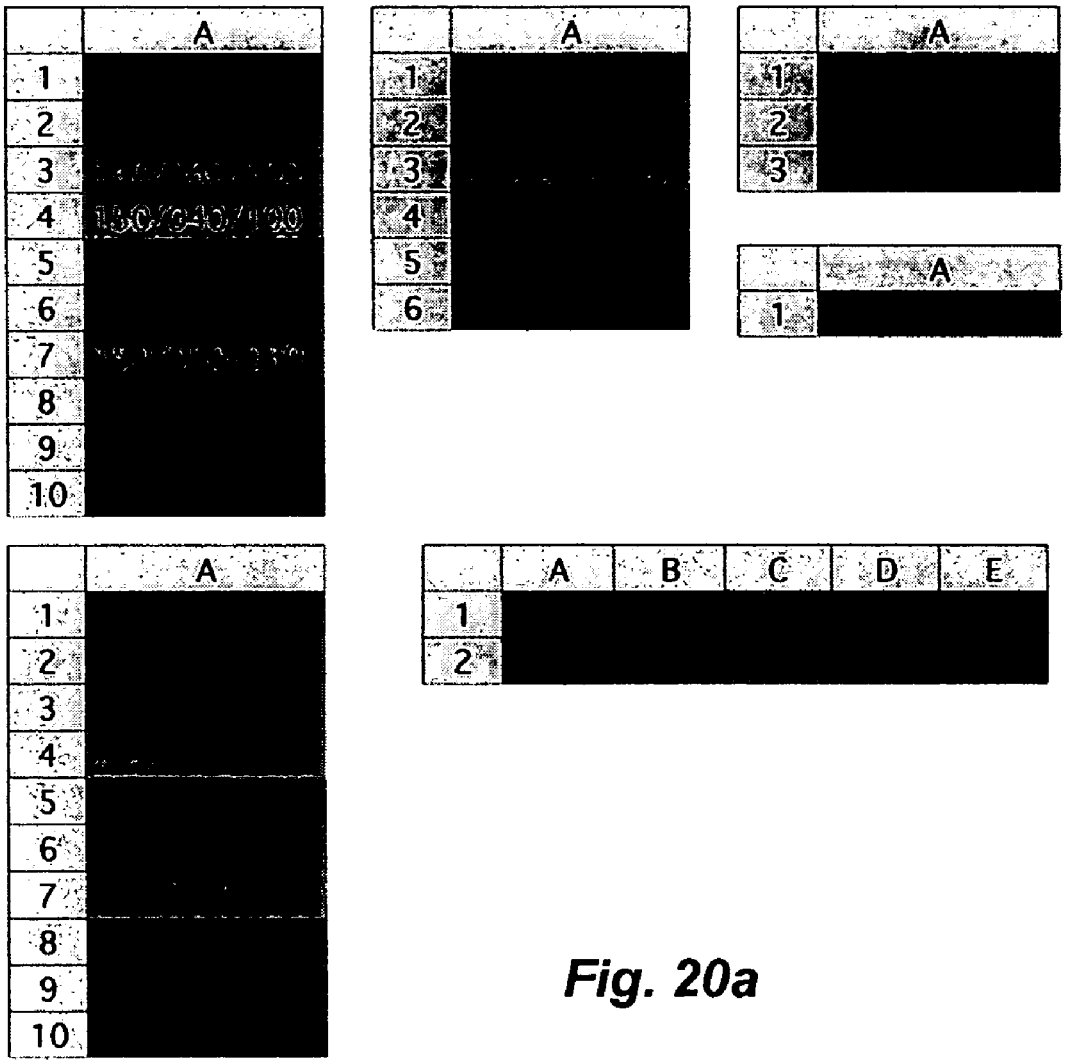
Figure 20B:
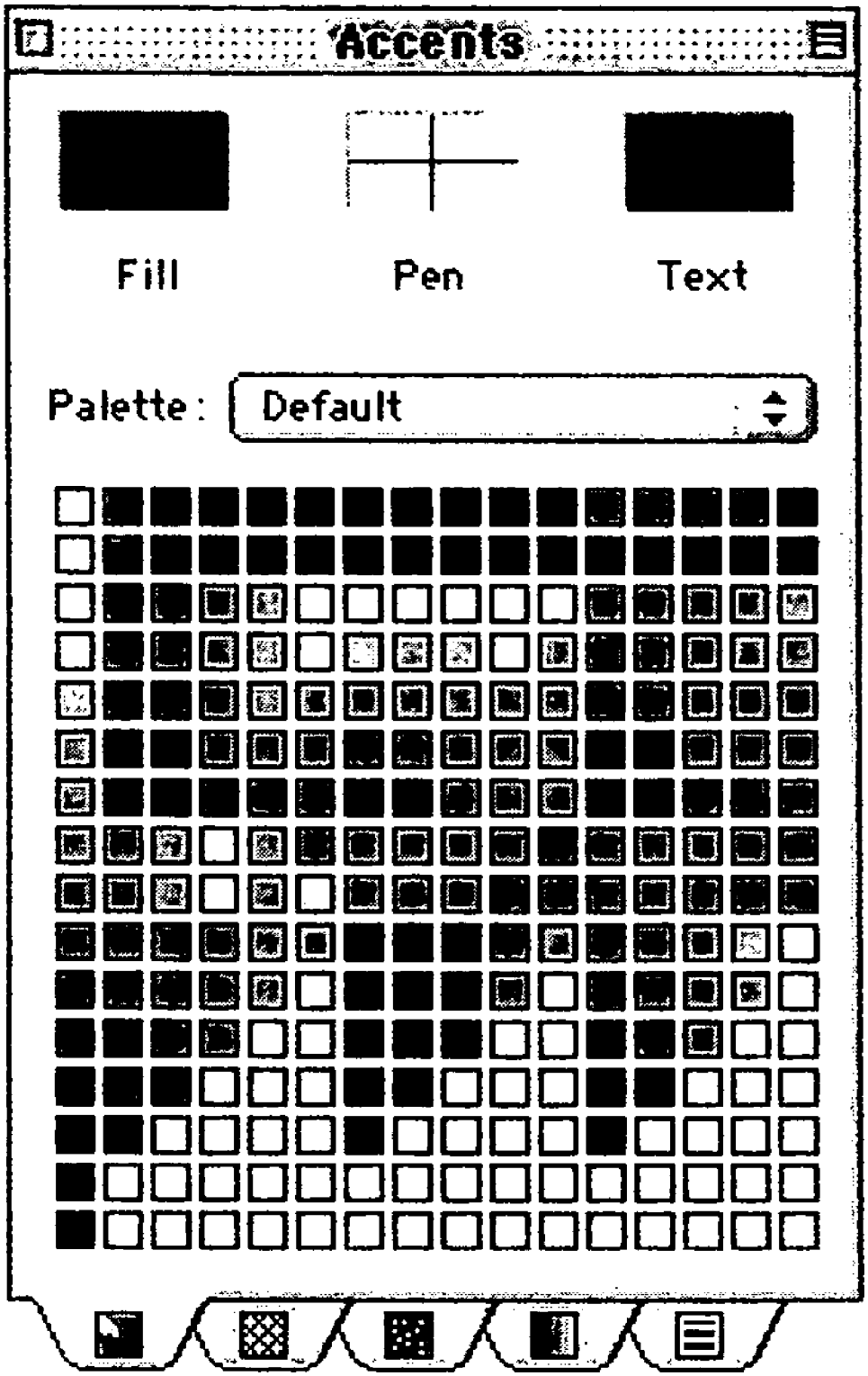
Figure 21A:
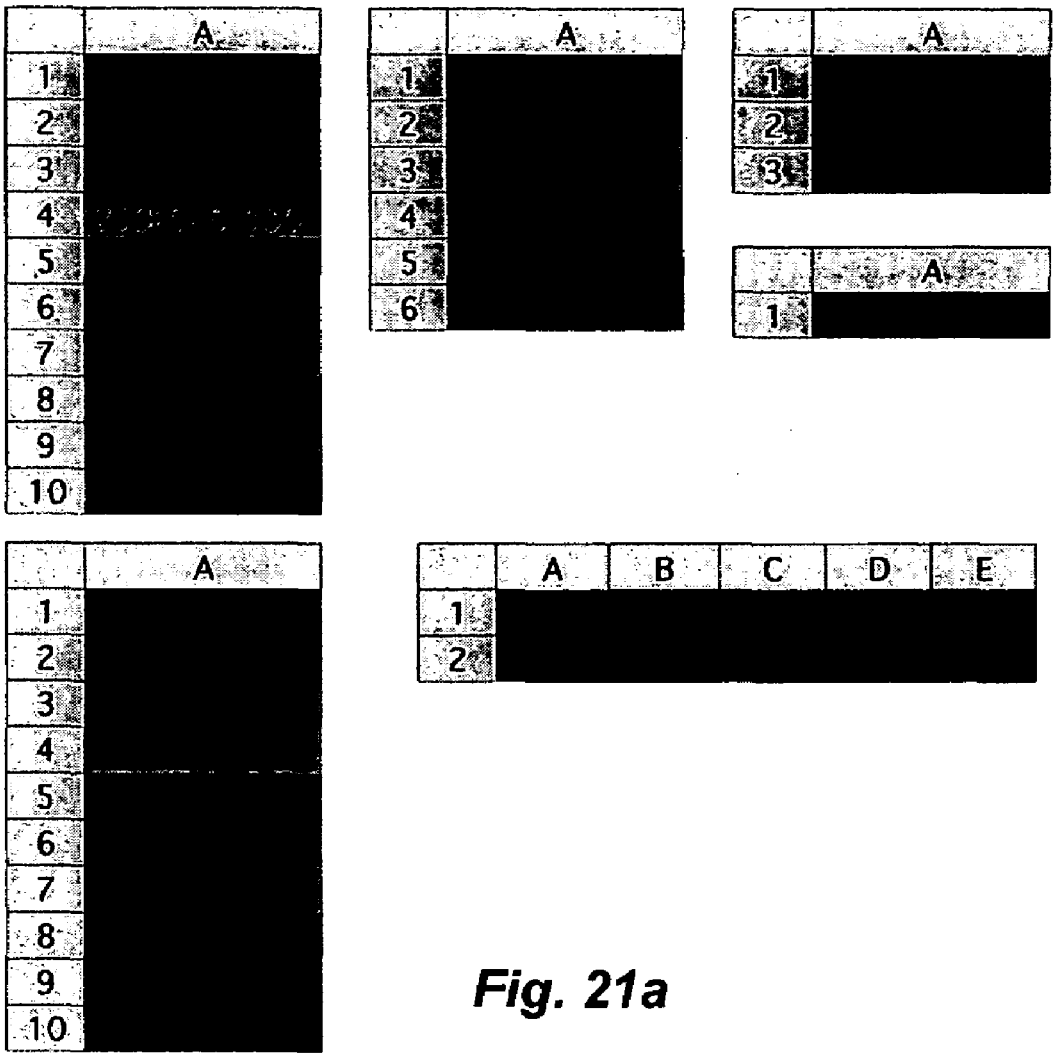
Figure 21B:
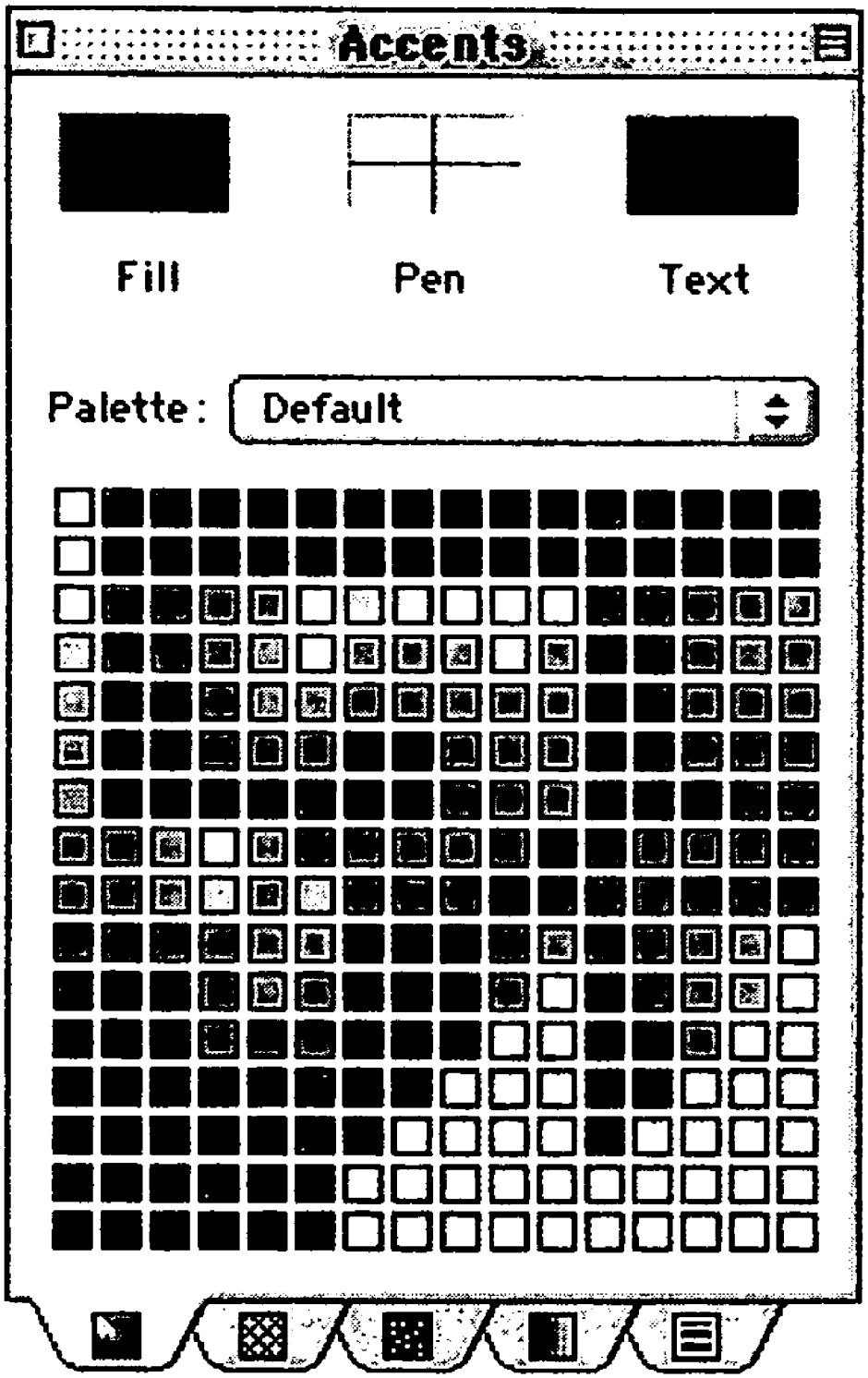
Figure 22A:
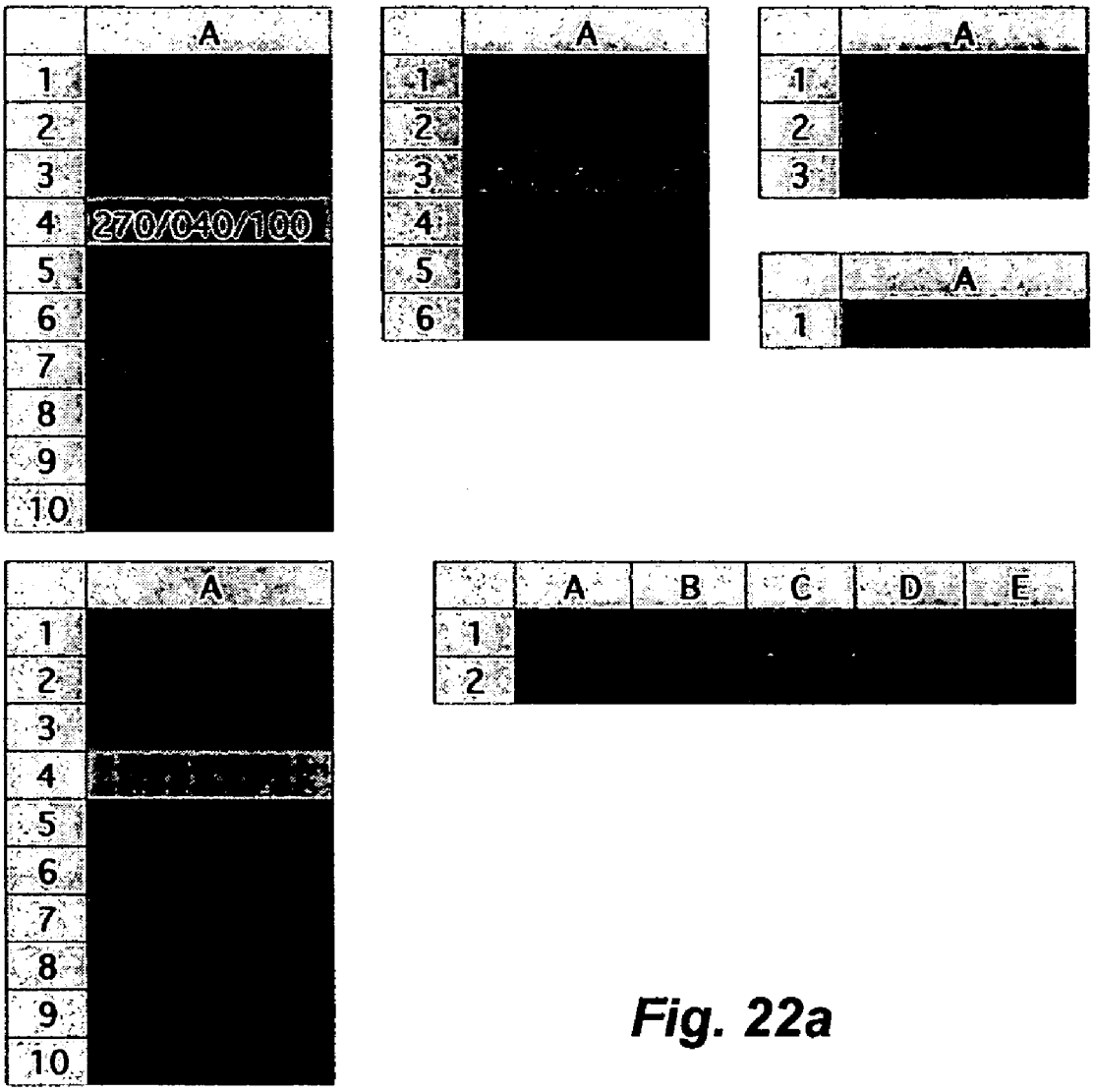
Figure 22B:
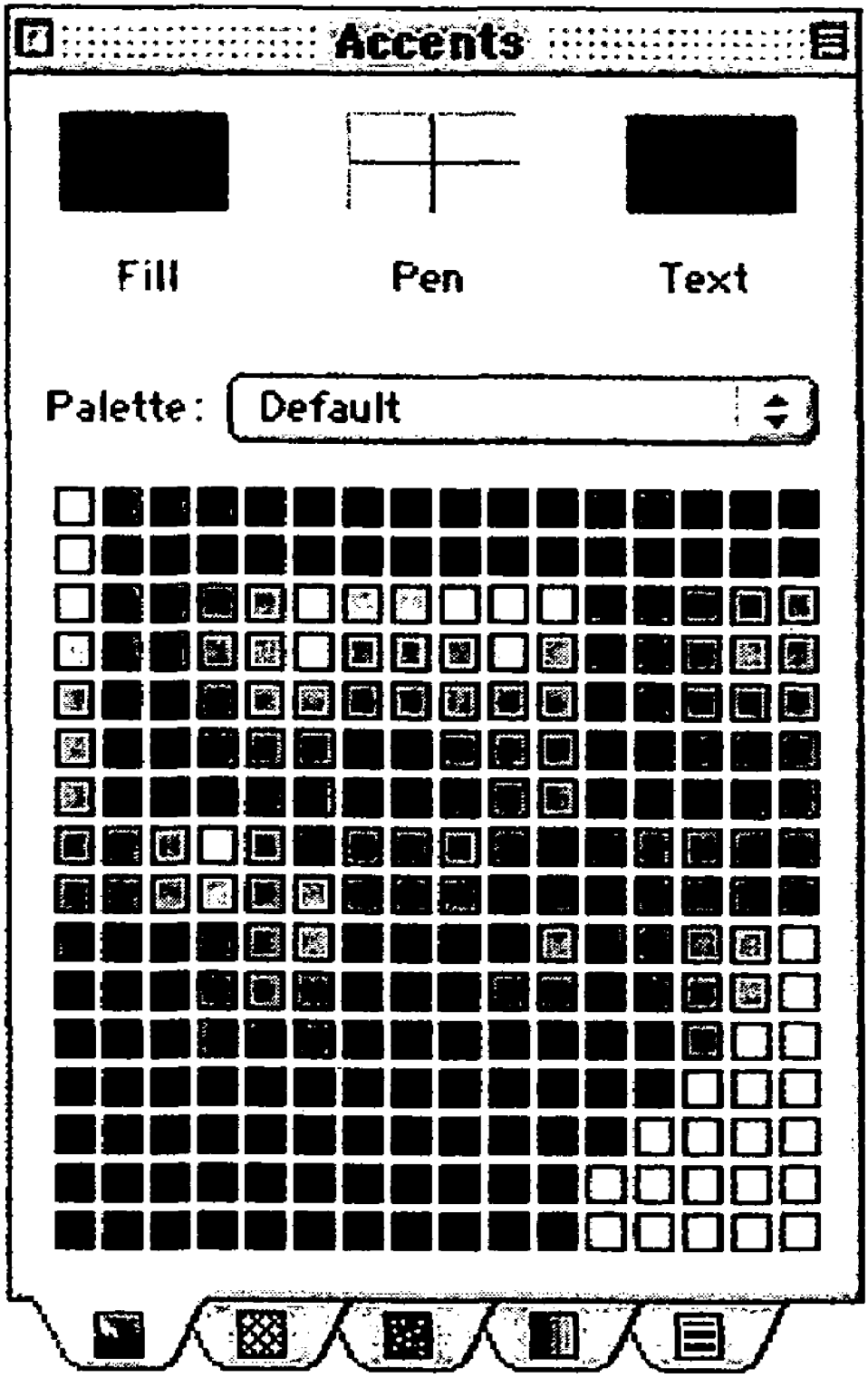
Figures 23A, 23B:
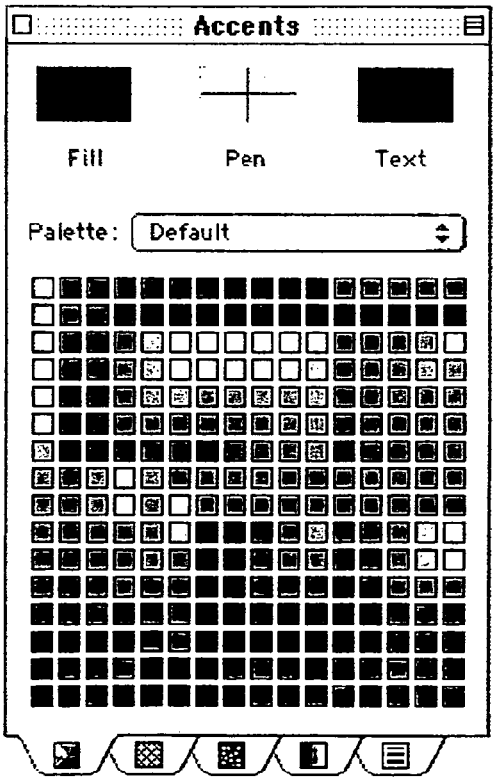

FIGS. 20*a* and 20*b* illustrate the colors in the range of 121° to 179° on the color wheel 305. These colors comprise a mixture of green and cyan, and are placed within the square and rectangle defined by the green blends, as described in connection with FIGS. 14*a*–14*c*. FIGS. 21*a* and 21*b* illustrate the colors in the range of 181° to 239° on the color wheel 305. These colors contain cyan and blue. They are placed in the square and rectangle defined by the cyan blends. FIGS. 22*a* and 22*b* illustrate the colors in the range of 241° to 299° on the color wheel 305. These colors contain blue and magenta, and are placed in the square and rectangle determined by the blue blends. Finally, FIGS. 23*a* and 23*b* illustrate the colors in the range of 301° to 359° on the color wheel 305. These colors are a mixture of magenta and red. They appear in the square and rectangle defined by the magenta blends.

Figure 24A:
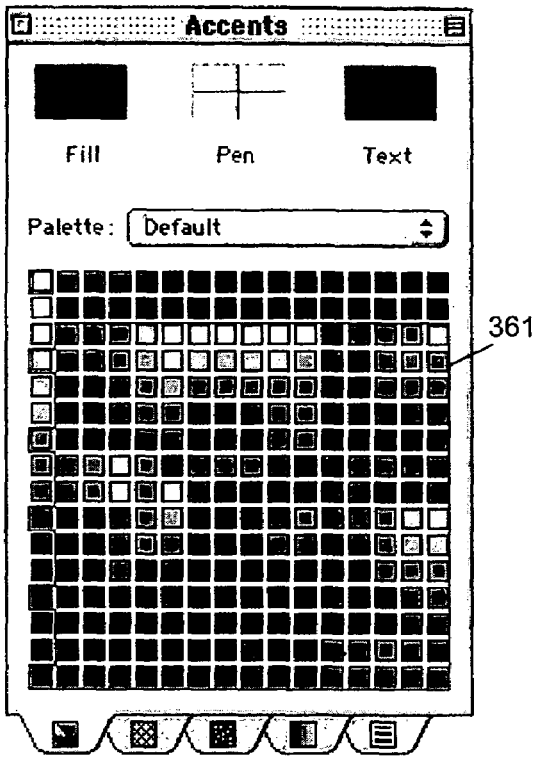
FIGS. 24*a*–24*b* are exemplary illustrations of one arrangement of colors on a color palette.
Figure 24B:
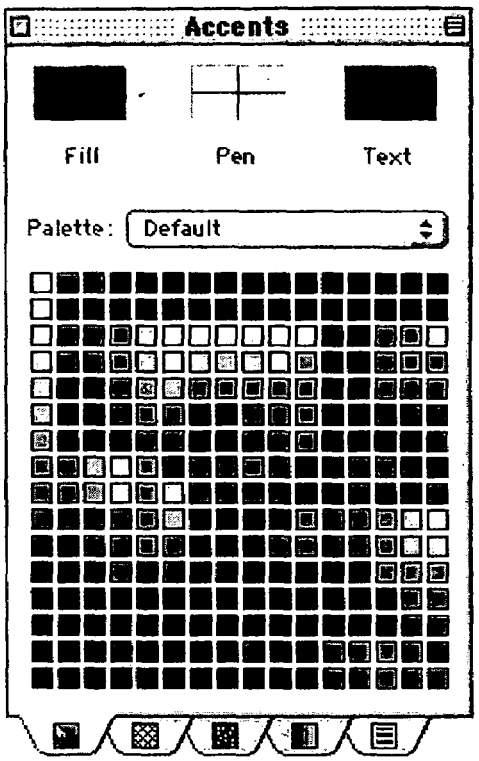

FIGS. 24*a* and 24*b* are exemplary illustrations of the finished color palette 360. The web-safe colors and non-web safe colors are separated as shown by the red outline 361 (FIG. 24*a*), where all web-safe colors are contained within the outline 361. Further, the achromatic and chromatic colors are separated and easily identified for ease of use. FIG. 24*b* illustrates the color palette as it may appear on the computer display 28.

Figure 25A:
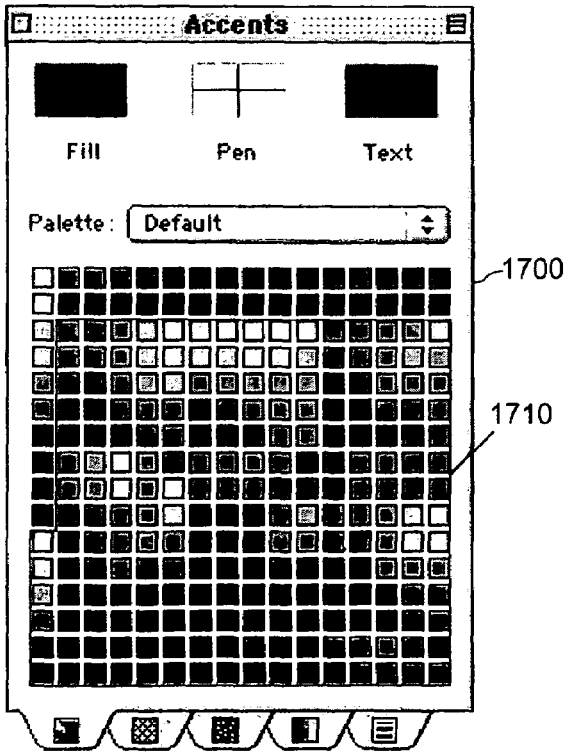
FIGS. 25*a*–25*b* are exemplary illustrations of another arrangement of colors on a color palette.
Figure 25B:
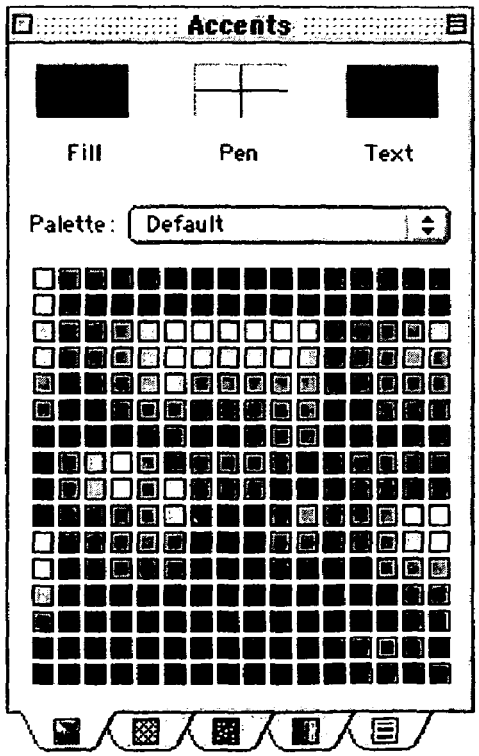

FIGS. 25*a* and 25*b* are exemplary illustrations of another color palette 1700. This color palette is identical to the color palette 360, except that the achromatic colors are separated into web-safe and non-web safe groupings. The red line 1710 outlines all the web-safe colors. The colors, achromatic and chromatic, contained outside the line 1710 are non web-safe colors. Color palette 1700 provides the advantage of user being able to distinguish between web-safe and non-web safe achromatic colors more easily. However, there may be less certainty as to which color is true white and which is true black, which are more easily identifiable in the color palette 360.

The foregoing example has been described in connection with a color palette that covers the full range of hue angles. The principles that are employed can also be applied to a smaller range of hue angles. For instance, the colors appearing in any one of the 5×5 squares associated with a given primary color, e.g., the red square 1145, can be expanded into their own 16×16 palette, to provide a finer resolution of colors. When they are arranged in the grid, the same order is followed, namely with decreasing saturation in one direction and decreasing value in the perpendicular direction.

While this invention has been described in conjunction with embodiments outlined above, it is evident that many alternatives, modifications and variations will be apparent to those skilled in the art. Accordingly, other embodiments of the invention may be made without departing from the spirit and scope of the invention.

What is claimed is:

1. A method for generating a color palette for presentation via a computer user interface to facilitate user selection of colors having a consistent appearance across different platforms during computer-implemented creation of an image, the method comprising the steps of:

determining achromatic colors to be located within a color palette;

arranging the achromatic colors in a first contiguous grouping within the palette;

placing blends of non web-safe chromatic colors in a second contiguous grouping adjacent to the first grouping within the palette;

placing web-safe chromatic colors, including blends created from the web- safe chromatic colors, in a third contiguous grouping within the palette adjacent to the second contiguous grouping such that the web-safe chromatic colors can be found in the third contiguous grouping;

wherein a subgroup of web-safe chromatic color blends are arranged within said third grouping to form a square wherein the colors are arranged on one side of a diagonal of the square horizontally in order of decreasing saturation towards said diagonal and vertically in order of decreasing value towards said diagonal, and the colors in the other side of the diagonal are arranged horizontally decreasing in value towards said diagonal and vertically decreasing in saturation towards said diagonal; and storing the generated color palette in a computer-readable memory for display and selection of individual colors during creation of an image on a computer by a user.

2. The method of claim 1 wherein the non web-safe chromatic colors are positioned within said second grouping by respective hues.

3. The method of claim 1 wherein the non-web safe blends are created from the non web-safe chromatic colors via incremental changes in saturation and value.

4. The method of claim 1 wherein the non web-safe blends of non web-safe chromatic colors are arranged in order from lightest to darkest within said second grouping.

5. The method of claim 1 wherein the web-safe chromatic colors are grouped by hue within said third grouping.

6. The method of claim 1 wherein said web-safe blends of web-safe chromatic colors are created via incremental changes in saturation and value.

7. The method of claim 1 wherein the colors on one side of said diagonal are primary colors and the colors on the other side of said diagonal are secondary colors.

8. The method of claim 1 wherein a subgroup of additional secondary colors are positioned adjacent their corresponding square and form a rectangle.

9. The method of claim 1 wherein said palette comprises a grid of rows and columns in which said colors are displayed, and at least one of said first, second and third contiguous groupings comprises one row or column of said grid.

10. The method of claim 9 wherein at least one of said first, second and third contiguous groupings is positioned in a row or column at an edge of said grid.

11. The method of claim 10 wherein said achromatic colors are arranged in order from lightest to darkest within said one row or column.

12. The method of claim 9 wherein said one row or column contains one contiguous subgroup of web-safe colors, and a second contiguous subgroup of non web-safe colors.

13. An apparatus which implements a color palette to facilitate user selection of web-safe colors, comprising:

a computer;

a storage device that stores the color palette; and a display device that displays the color palette;

wherein the color palette is organized into a first contiguous grouping of achromatic colors, a second contiguous grouping of non web-safe chromatic colors positioned adjacent to the first contiguous grouping, and a third contiguous grouping of web-safe chromatic colors, including blends that are created from the web-safe chromatic colors, the third contiguous grouping positioned adjacent to the first contiguous grouping such that the web-safe colors are found by the user wherein a subgroup of web-safe chromatic color blends are arranged within said third grouping to form a square wherein the colors are arranged on one side of a diagonal of the square horizontally in order of decreasing saturation towards said diagonal and vertically in order of decreasing value towards said diagonal, and the colors in the other side of the diagonal are arranged horizontally decreasing in value towards said diagonal and vertically decreasing in saturation towards said diagonal.

14. The apparatus of claim 13 wherein the non web-safe chromatic colors are positioned within said second grouping by respective hues.

15. The apparatus of claim 13 wherein the non-web safe blends are created from the non web-safe chromatic colors via incremental changes in saturation and value.

16. The apparatus of claim 13 wherein the non web-safe blends of non web-safe chromatic colors are arranged in order from lightest to darkest within said second grouping.

17. The apparatus of claim 13 wherein the web-safe chromatic colors are grouped by hue within said third grouping.

18. The apparatus of claim 13 wherein said web-safe blends of web-safe chromatic colors are created via incremental changes in saturation and value.

19. A method for producing a color palette which facilitates user selection of colors having a consistent appearance across different computer platforms, comprising the steps of:

determining the achromatic colors to be located within a color palette;

arranging all the achromatic colors in one contiguous grouping within the palette;

placing blends of non web-safe chromatic colors in a second contiguous grouping within the palette;

placing web-safe chromatic colors, including blends created from the web-safe chromatic colors, in a third contiguous grouping within the palette; and storing said palette on a computer-readable memory for display and selection of individual colors during the creation of an image on a computer by a user.

20. The method of claim 19, wherein the non web-safe chromatic colors are positioned within said second grouping by their respective hues.

21. The method of claim 19, wherein the non web-safe blends are created from the non web-safe chromatic colors via incremental changes in saturation and value.

22. The method of claim 19, wherein the blends of non web-safe chromatic colors are arranged in order from lightest to darkest within said second grouping.

23. The method of claim 19, wherein the web-safe chromatic colors are grouped by hue within said third grouping.

24. The method of claim 19, wherein said blends of web-safe chromatic colors are created via incremental changes in saturation and value.

25. The method of claim 19, wherein said palette comprises a grid of rows and columns in which said colors are displayed, and said one grouping comprises one row or column of said grid.

26. The method of claim 25, wherein said one grouping is positioned in a row or column at an edge of said grid.

27. The method of claim 25, wherein said achromatic colors are arranged in order from lightest to darkest within said one row or column.

28. The method of claim 25 wherein said one row or column contains one contiguous subgroup of web-safe colors, and a second contiguous subgroup of non web-safe colors.

29. A method for producing a color palette containing both web-safe colors and non web-safe colors, so as to facilitate user selection of colors having a consistent appearance across different computer platforms, comprising the steps of:

placing blends of non web-safe chromatic colors in a first contiguous grouping within a first area on the palette;

placing web-safe chromatic colors, including blends created from the web-safe chromatic colors, in a second contiguous grouping within a second area on said palette; and storing said palette on a computer-readable memory for display and selection of individual colors during the creation of an image on a computer by a user.

30. The method of claim 29, wherein the non web-safe chromatic colors are positioned within said first grouping by their respective hues.

31. The method of claim 29, wherein the non web-safe blends are created from the non web-safe chromatic colors via incremental changes in saturation and value.

32. The method of claim 29, wherein the blends of non web-safe chromatic colors are arranged in order from lightest to darkest within said first grouping.

33. The method of claim 29, wherein the web-safe chromatic colors are grouped by hue within said second grouping.

34. The method of claim 29, wherein said blends of web-safe chromatic colors are created via incremental changes in saturation and value.

35. A display device for a computer system on which is displayed a color palette comprising a first contiguous grouping of non web-safe chromatic colors and a second contiguous grouping of web-safe chromatic colors, including blends created from the web-safe chromatic colors, for selection of individual colors from said palette during computer-assisted creation of an image by a user.

36. The display device of claim 35, wherein the non web-safe chromatic colors are positioned within said first grouping by their respective hues.

37. The display device of claim 35, wherein the non web-safe blends are created from the non web-safe chromatic colors via incremental changes in saturation and value.

38. The display device of claim 35, wherein the blends of non web-safe chromatic colors are arranged in order from lightest to darkest within said first grouping.

39. The display device of claim 35, wherein the web-safe chromatic colors are grouped by hue within said second grouping.

40. The display device of claim 35, wherein said blends of web-safe chromatic colors are created via incremental changes in saturation and value.

41. The display device of claim 35, wherein said palette further comprises a third contiguous grouping of achromatic colors.

42. The display device of claim 41, wherein said palette comprises a grid of rows and columns in which said colors are displayed, and said third contiguous grouping comprises a row or column of said grid.

43. The display device of claim 42, wherein said row or column comprising said third contiguous grouping is located at an edge of said grid.

* * * * *